US009028032B2

(12) United States Patent
Tamiya et al.

(10) Patent No.: US 9,028,032 B2
(45) Date of Patent: May 12, 2015

(54) PRINTING APPARATUS AND REGISTRATION ADJUSTMENT METHOD

(71) Applicant: Canon Kabushiki Kaisha, Tokyo (JP)

(72) Inventors: Keita Tamiya, Kawasaki (JP); Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/865,328

(22) Filed: Apr. 18, 2013

(65) Prior Publication Data

US 2013/0286075 A1 Oct. 31, 2013

(30) Foreign Application Priority Data

Apr. 27, 2012 (JP) ..... 2012-103834
Apr. 2, 2013 (JP) ..... 2013-077263

(51) Int. Cl.

*B41J 29/38* (2006.01)
*B41J 29/393* (2006.01)
*B41J 13/26* (2006.01)
*B41J 2/21* (2006.01)

(52) U.S. Cl.

CPC *B41J 13/26* (2013.01); *B41J 29/38* (2013.01); *B41J 2/2135* (2013.01)

(58) Field of Classification Search

USPC ..... 347/19, 16
See application file for complete search history.

(56) References Cited

U.S. PATENT DOCUMENTS 6,257,143 B1 7/2001 Iwasaki et al.
7,505,057 B2 3/2009 Yoshida
7,625,057 B2 12/2009 Koase
2005/0248606 A1* 11/2005 Hoshiyama et al. ..... 347/19
2009/0237437 A1 9/2009 Uchida
2011/0141179 A1* 6/2011 Hara ..... 347/15
2012/0169810 A1 7/2012 Nishioka et al.
2013/0050324 A1* 2/2013 Uchida ..... 347/14

FOREIGN PATENT DOCUMENTS

CN 1782908 A 6/2006
CN 102161260 A 8/2011
JP 2000-037936 A 2/2000
JP 2008-149625 A 7/2008
JP 2009-056746 A 3/2009
JP 4296043 B2 7/2009
JP 2011-064825 A 3/2011

OTHER PUBLICATIONS

Notification of First Office Action—Chinese Patent Appln. No. 201310156677.X, State Intellectual Property Office of the Peoples Republic of China, Sep. 3, 2014.

* cited by examiner

*Primary Examiner* — Jason Uhlenhake
(74) *Attorney, Agent, or Firm* — Fitzpatrick, Cella, Harper & Scinto

(57) ABSTRACT

An embodiment of this invention solves a problem about a precision drop of registration adjustment of a range detection method due to variations of a registration state depending on a position associated with a carriage scanning direction. In that embodiment, reference and adjustment patterns are formed to be juxtaposed in a nozzle array direction to detect a position shift between patterns in the main scanning direction. In this case, coarse registration adjustment is executed by the range detection method, and its adjustment result is applied to a printing apparatus. After that, fine registration adjustment is executed by a density method, and results of the two adjustment methods are finally reflected.

24 Claims, 20 Drawing Sheets

FIG. 5

| TYPE OF CORRECTION VALUE |
| --- |
| Even-Odd ARRAY CORRECTION VALUE (A ARRAY) |
| Even-Odd ARRAY CORRECTION VALUE (B ARRAY) |
| A-B ARRAY CORRECTION VALUE |
| FORWARD-BACKWARD CORRECTION VALUE |
| INTER-CHIP CORRECTION VALUE |

R1
R2
R
4
106
107
Vcr
v
h
$R = \frac{h}{v} \cdot Vcr \times 2$

| TYPE OF CORRECTION VALUE | REFERENCE | ADJUSTMENT | DIFFERENCE IN LINE DIRECTION |
|---|---|---|---|
| Even-Odd ARRAY CORRECTION VALUE (A ARRAY) | Line3 | Line1 | 2 |
| Even-Odd ARRAY CORRECTION VALUE (B ARRAY) | Line4 | Line5 | 1 |
| A-B ARRAY CORRECTION VALUE | Line3 | Line4 | 1 |
| FORWARD-BACKWARD CORRECTION VALUE | Line3 | Line2 | 1 |

PRINTING APPARATUS AND REGISTRATION ADJUSTMENT METHOD

BACKGROUND OF THE INVENTION

1. Field of the Invention

The present invention relates to a printing apparatus and a registration adjustment method used in the apparatus, and particularly to, for example, a printing apparatus including a plurality of inkjet printheads and a registration adjustment method used in the apparatus.

2. Description of the Related Art

A printing apparatus including an inkjet printhead (to be referred to as a printhead hereinafter) forms dots on a print medium by discharging ink droplets from the printhead, and forms an image by the dots. A dot alignment technique between different conditions is called a registration correction technique, and alignment of dots is implemented by acquiring and applying a correction value.

A method of acquiring this correction value by visually observing a printed pattern by the user, and applying that correction value, a method of reading a printed pattern by a sensor included in a printing apparatus, and executing automatic adjustment, and the like are available.

As one automatic adjustment method, a method of directly detecting a position shift distance of patterns formed under a plurality of printing conditions using a sensor, and acquiring that distance as a correction amount is known. This method is called a range detection method.

For example, Japanese Patent Laid-Open No. 2009-56746 has proposed a conventional registration adjustment method.

In a printer which executes printing on a print medium of a large size such as an A0 or B0 print sheet by reciprocally scanning a carriage that mounts a printhead, it is difficult to maintain a stable state all over that scanning region.

External disturbances which influence stable printing include a variation of a distance between the printhead and print sheet, an attitude variation of the carriage, and the like. These external disturbances occur depending on a position in the carriage moving direction. For this reason, the apparatus state varies depending on a registration adjustment position, and a correction value cannot often be correctly calculated. Especially, in the range detection method, the influences caused by external disturbances occurred between a plurality of patterns used to compare position shifts often directly result in errors of the correction value.

SUMMARY OF THE INVENTION

Accordingly, the present invention is conceived as a response to the above-described disadvantages of the conventional art.

For example, a printing apparatus and a registration adjustment method used in the apparatus according to this invention are capable of eliminating the influences of external disturbances occurred depending on positions of a carriage in the moving direction, and attaining satisfactory registration adjustment.

According to one aspect of the present invention, there is provided a printing apparatus, which executes printing by reciprocally scanning a carriage, to which a printhead having a first nozzle array in which a plurality of nozzles are arrayed in a first direction and a second nozzle array in which a plurality of nozzles are arrayed in the first direction is mounted, in a second direction intersecting with the first direction, comprising: a first print unit configured to print a first adjustment pattern on a print medium using the first nozzle array and the second nozzle array of the printhead; a first acquisition unit configured to acquire a first registration adjustment value based on a distance between print positions of two patches of a plurality of patches that form the first adjustment pattern; a second print unit configured to print, on a print medium, a second adjustment pattern different from the first adjustment pattern using the first nozzle array and the second nozzle array of the printhead in a state in which a registration of the printhead is adjusted by the first registration adjustment value; and a second acquisition unit configured to acquire a second registration adjustment value based on densities of a plurality of patches that form the second adjustment pattern.

According to another aspect of the present invention, there is provided a printing apparatus, which executes printing by reciprocally scanning a carriage, to which a printhead having a nozzle array in which a plurality of nozzles are arrayed in a first direction is mounted, in a second direction intersecting with the first direction, comprising: a first print unit configured to print a first adjustment pattern on a print medium using the nozzle array of the printhead by a scan in a forward direction and by a scan in a backward direction of the carriage, respectively; a first acquisition unit configured to acquire a first registration adjustment value based on a distance between print positions of two patches of a plurality of patches that form the first adjustment pattern; a second print unit configured to print, on a print medium, a second adjustment pattern different from the first adjustment pattern using the nozzle array of the printhead by the scan in the forward direction and by the scan in the backward direction, respectively, in a state in which a registration of the printhead is adjusted by the first registration adjustment value; and a second acquisition unit configured to acquire a second registration adjustment value based on densities of a plurality of patches that form the second adjustment pattern.

According to still another aspect of the present invention, there is provided a registration adjustment method for a printing apparatus, which executes printing by reciprocally scanning a carriage, to which a printhead having a first nozzle array in which a plurality of nozzles are arrayed in a first direction and a second nozzle array in which a plurality of nozzles are arrayed in the first direction is mounted, in a second direction intersecting with the first direction, comprising: printing a first adjustment pattern on a print medium using the first nozzle array and the second nozzle array of the printhead; acquiring a first registration adjustment value based on a distance between print positions of two patches of a plurality of patches that form the first adjustment pattern; printing, on a print medium, a second adjustment pattern different from the first adjustment pattern using the first nozzle array and the second nozzle array of the printhead in a state in which a registration of the printhead is adjusted by the first registration adjustment value; and acquiring a second registration adjustment value based on densities of a plurality of patches that form the second adjustment pattern.

According to still another aspect of the present invention, there is provided a registration adjustment method for a printing apparatus, which executes printing by reciprocally scanning a carriage, to which a printhead having a nozzle array in which a plurality of nozzles are arrayed in a first direction is mounted, in a second direction intersecting with the first direction, comprising: printing a first adjustment pattern on a print medium using the nozzle array of the printhead by a scan in a forward direction and by a scan in a backward direction of the carriage, respectively; acquiring a first registration adjustment value based on a distance between print positions of two patches of a plurality of patches that form the first adjustment pattern; printing, on a print medium, a second adjustment pattern different from the first adjustment pattern using the nozzle array of the printhead by the scan in the forward direction and by the scan in the backward direction, respectively, in a state in which a registration of the printhead is adjusted by the first registration adjustment value; and acquiring a second registration adjustment value based on densities of a plurality of patches that form the second adjustment pattern.

The invention is particularly advantageous since registration adjustments of two steps of different methods are executed to make satisfactory registration adjustment which utilizes the advantages of the respective methods. This invention is particularly effective in a printing apparatus which executes printing using print media of A0 and B0 sizes, has a large carriage moving length, and is configured to include a plurality of large printheads each including a plurality of nozzle arrays.

Further features of the present invention will become apparent from the following description of exemplary embodiments (with reference to the attached drawings).

BRIEF DESCRIPTION OF THE DRAWINGS

FIG. 5 is a table showing types of registration correction values.

DESCRIPTION OF THE EMBODIMENT

An exemplary embodiment of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") generically means an ink orifice or a liquid channel communicating with it, and an element for generating energy used to discharge ink, unless otherwise specified.

<Overview of Printing Apparatus (FIGS. 1A and 1B)>

Figure 1A:
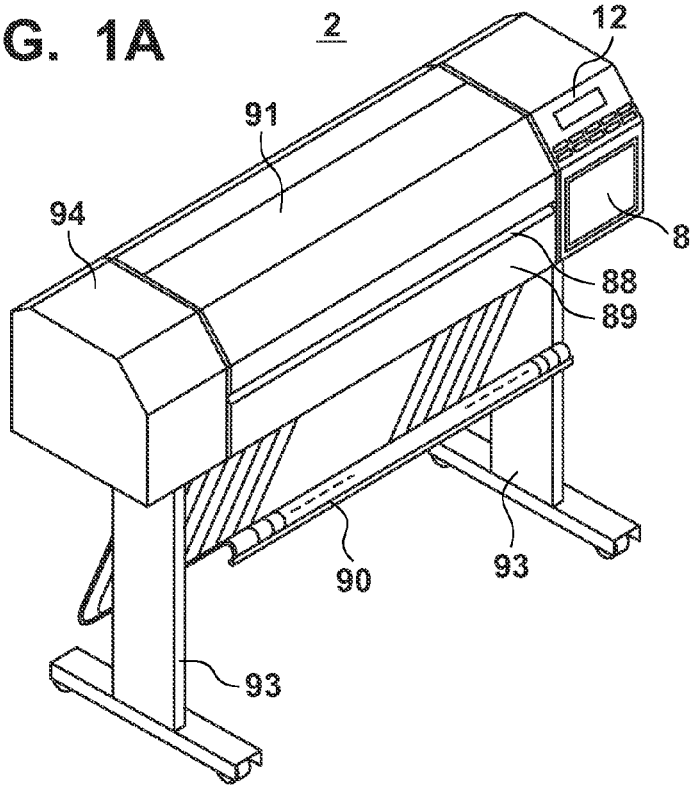
FIGS. 1A and 1B are perspective views showing the outer appearance of a printing apparatus, which uses print media of A0 and B0 sizes, as an exemplary embodiment of the present invention.
Figure 1B:
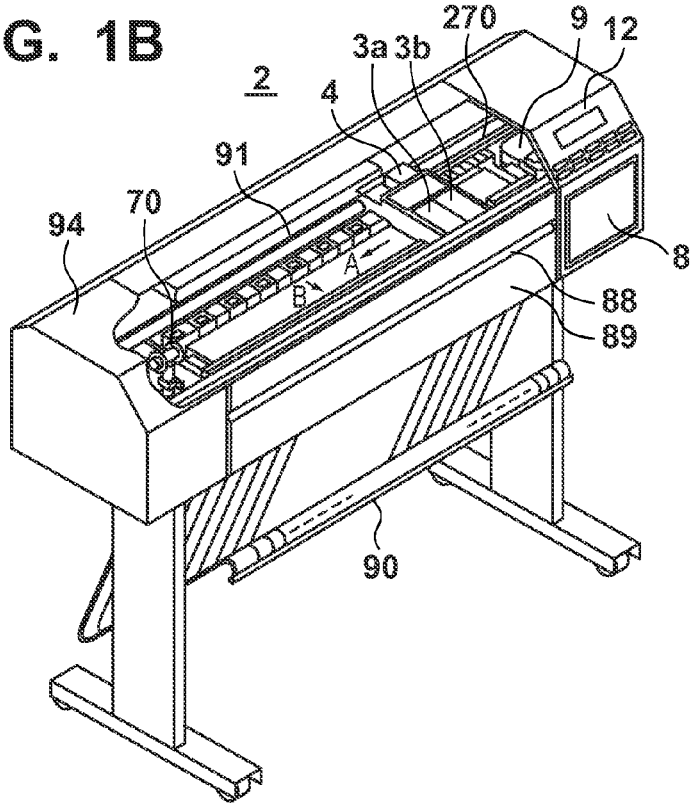

FIGS. 1A and 1B are perspective views showing the outer appearance of a printing apparatus, which uses print media of A0 and B0 sizes, as an exemplary embodiment of the present invention. FIG. 1B is a perspective view showing a state in which an upper cover of the printing apparatus shown in FIG. 1A is removed.

As shown in FIG. 1A, a manual insertion port 88 is formed on a front surface of a printing apparatus 2, and a roll paper cassette 89 which is free to be open/close to the front surface is arranged below the manual insertion port 88. A print medium such as a print sheet is supplied from the manual insertion port 88 or roll paper cassette 89 into the printing apparatus. The printing apparatus 2 includes an apparatus main body 94 which is supported by two leg portions 93, a stacker 90 which stacks exhausted print media, and a transparent upper cover 91 which allows the user to see through the interior of the apparatus, and is free to be open/close. An operation unit 12, ink supply unit, and ink tank 8 are arranged on the right side of the apparatus main body 94.

As shown in FIG. 1B, the printing apparatus 2 further includes a conveyance roller 70 required to convey a print medium in a direction of an arrow B (sub-scanning direction), and a carriage 4 which is guided and supported to be reciprocally movable in a widthwise direction (direction of an arrow A, main scanning direction) of a print medium. The printing apparatus 2 further includes a carriage motor (not shown) and a carriage belt (to be referred to as a belt hereinafter) 270, which are required to reciprocally move the carriage 4 in the direction of the arrow A, and printheads 3*a* and 3*b* mounted on the carriage 4. Moreover, the printing apparatus 2 includes a suction ink recovery unit 9 required to supply inks and to recover an ink discharge failure caused by clogging of orifices of the printheads 3*a* and 3*b*.

In case of this printing apparatus, the printheads 3*a* and 3*b* (which are often referred to as head units 3*a* and 3*b* hereinafter) which discharge inks of six colors in correspondence with color inks of 12 colors, so as to attain color printing on a print medium are mounted on the carriage 4. The head units 3*a* and 3*b* adopt the same arrangement. These head units 3*a* and 3*b* will also be collectively referred to as a printhead 3 hereinafter. The relationship between the head units and carriage, and the detailed arrangement of each head unit will be described later.

When printing is performed on a print medium by the aforementioned arrangement, the print medium is conveyed by the conveyance roller 70 to a predetermined printing start position. After that, an operation for scanning the printheads 3*a* and 3*b* in the main scanning direction by the carriage 4, and an operation for conveying the print medium in the sub-scanning direction by the conveyance roller 70 are repeated, thus attaining printing on the entire print medium.

That is, when the carriage 4 is moved in the direction of the arrow A shown in FIG. 1B by the belt 270 and carriage motor (not shown), printing is attained on the print medium. When the carriage 4 is returned to a position before scanning (home position), the print medium is conveyed in the sub-scanning direction (direction of the arrow B shown in FIG. 1B) by the conveyance roller, and the carriage is then scanned in the direction of the arrow A in FIG. 1B. In this manner, images, characters, and the like are printed on the print medium. After printing for one sheet ends by repeating the aforementioned operations, that print medium is exhausted into the stacker 90, thus completing printing for one sheet.

<Description of Control Arrangement (FIG. 2)>

The control arrangement required to execute printing control of the printing apparatus described above using FIGS. 1A and 1B will be described below.

Figure 2:
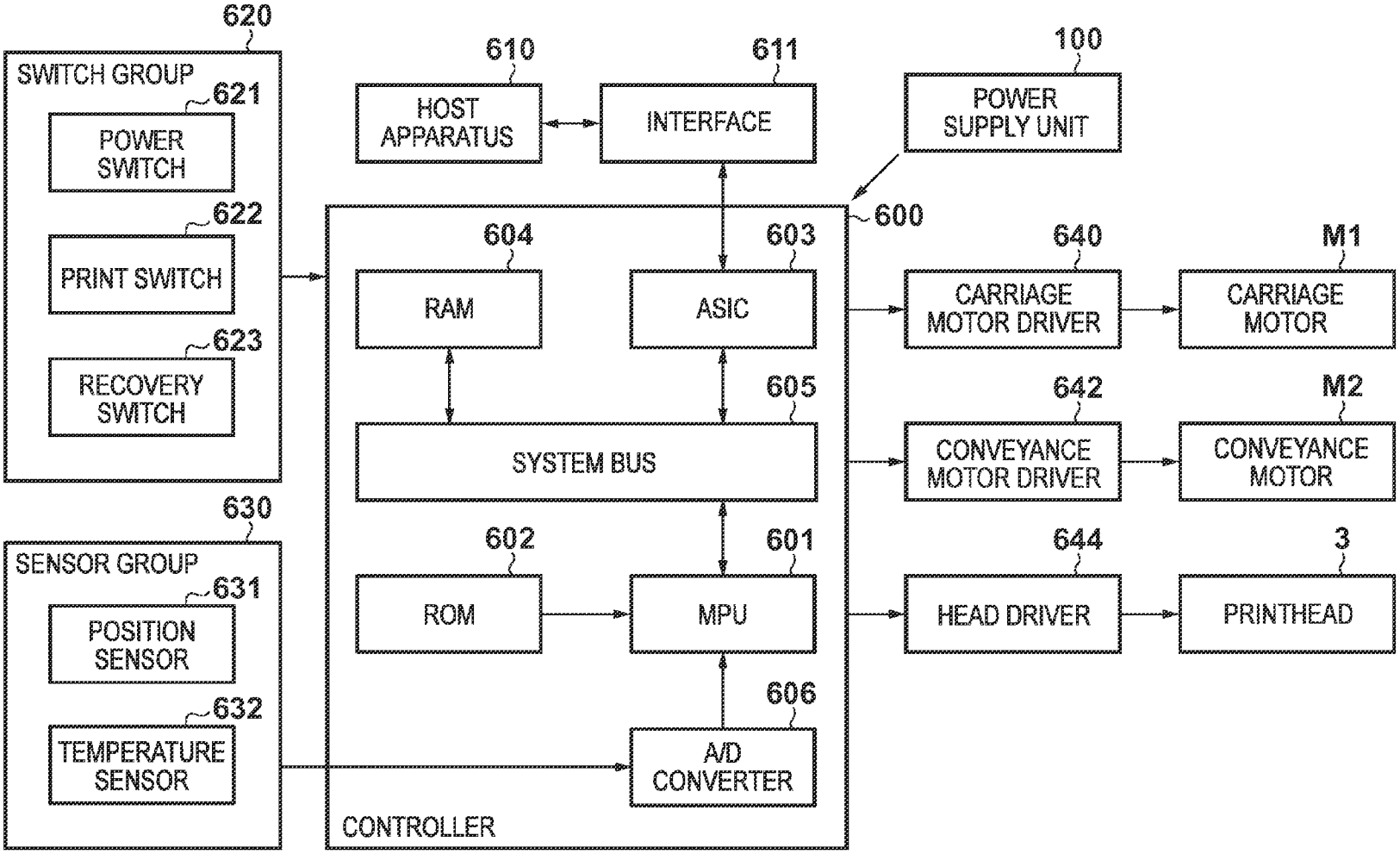
FIG. 2 is a block diagram showing the control arrangement of the printing apparatus shown in FIGS. 1A and 1B.

FIG. 2 is a block diagram showing the control arrangement of the printing apparatus shown in FIGS. 1A and 1B.

As shown in FIG. 2, a controller 600 includes an MPU 601, ROM 602, ASIC (Application Specific Integrated Circuit) 603, RAM 604, system bus 605, A/D converter 606, and the like. Note that the ROM 602 stores a program corresponding to a control sequence (to be described later), required tables, and other permanent data. The ASIC 603 generates control signals required to control a carriage motor M1, to control a conveyance motor M2, and to control the printhead 3 (printheads 3*a* and 3*b*). The RAM 604 is used as an expansion area for image data, a work area required to execute a program, and the like. The system bus 605 connects the MPU 601, ASIC 603, and RAM 604 to each other so as to exchange data. The A/D converter 606 A/D-converts analog signals input from a sensor group (to be described later), and supplies digital signals to the MPU 601.

In FIG. 2, reference numeral 610 denotes a computer (or an image reader, digital camera, or the like) which serves as a supply source of image data, and is called a host apparatus. The host apparatus 610 and printing apparatus 2 exchange image data, commands, status signals, and the like via an interface (I/F) 611. This image data is input in, for example, a raster format.

Furthermore, reference numeral 620 denotes a switch group which includes a power switch 621, print switch 622, recovery switch 623, and the like.

Reference numeral 630 denotes a sensor group which is used to detect apparatus states, and includes a position sensor 631, temperature sensor 632, and the like.

Moreover, reference numeral 640 denotes a carriage motor driver required to drive the carriage motor M1 used to reciprocally scan the carriage 4 in the direction of the arrow A; and 642, a conveyance motor driver required to drive the conveyance motor M2 used to convey a print medium. Reference numeral 644 denotes a head driver required to drive the printheads based on print data and control signals transferred from the controller 600.

The ASIC 603 transfers data required to drive printing elements (discharge heaters) to the printhead while directly accessing a storage area of the RAM 604 at the time of print scans by the printhead 3.

A power supply unit 100 supplies electric power to the controller 600. Also, the power supply unit 100 can also supply electric power required to operate respective units of the apparatus such as the drivers, motors, printhead, sensor group, switch group, mechanism portions, and the like.

<Detailed Arrangement Around Carriage (FIG. 3)>

Figure 3:
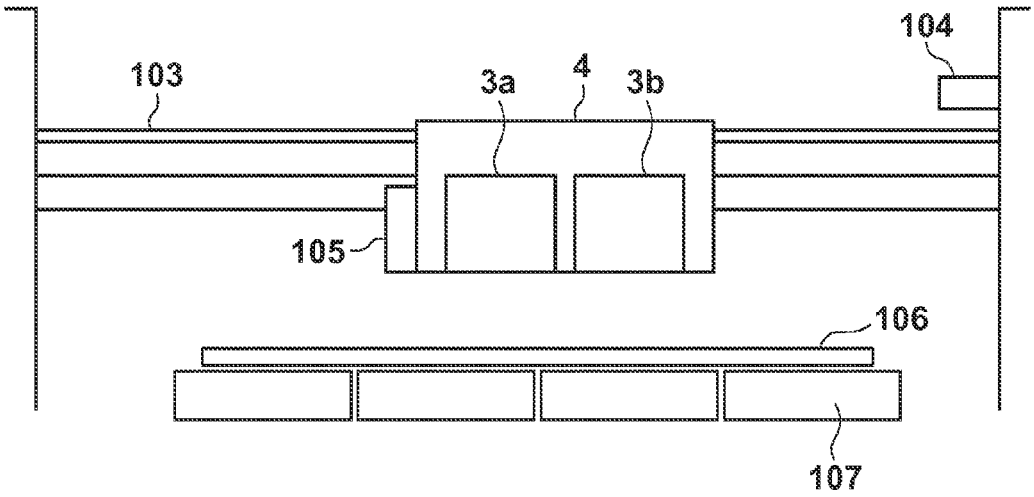
FIG. 3 is a partial top view of a printing apparatus 2 to show the arrangement around a carriage of the printing apparatus 2 shown in FIGS. 1A and 1B.

FIG. 3 is a partial top view of the printing apparatus 2 to show the arrangement around the carriage of the printing apparatus 2 shown in FIGS. 1A and 1B. As shown in FIG. 3, the reciprocally supported carriage 4 has two pockets, and the head units 3*a* and 3*b* are mounted on these pockets. Also, the carriage 4 includes a reflective-type sensor 105, which is reciprocally moved in the main scanning direction together with the carriage 4.

The position of the carriage 4 is detected by reading a scale 103 arranged along the main scanning direction by an encoder (not shown) provided to the carriage 4. That read count is reset by an origin sensor 104 provided to the end portion of the printing apparatus 2. Therefore, a count value of the encoder is that from the position of the origin sensor.

A print sheet 106 is pressed by a pinch roller (not shown), and is held on a flat platen 107. Since print sheets to be used of this embodiment have large sizes such as A0 and B0, they have large paper widths, and the platen 107 is configured to be divided into some portions. Due to such divisional configuration, platen heights suffer variations due to their attachment states, and often cause a variation factor of a distance between the print sheet and printhead. The print sheet is conveyed in the sub-scanning direction by the conveyance roller 70 (not shown in FIG. 3).

<Arrangement of Printhead (Head Unit) (FIGS. 4A and 4B)>

Figure 4A:
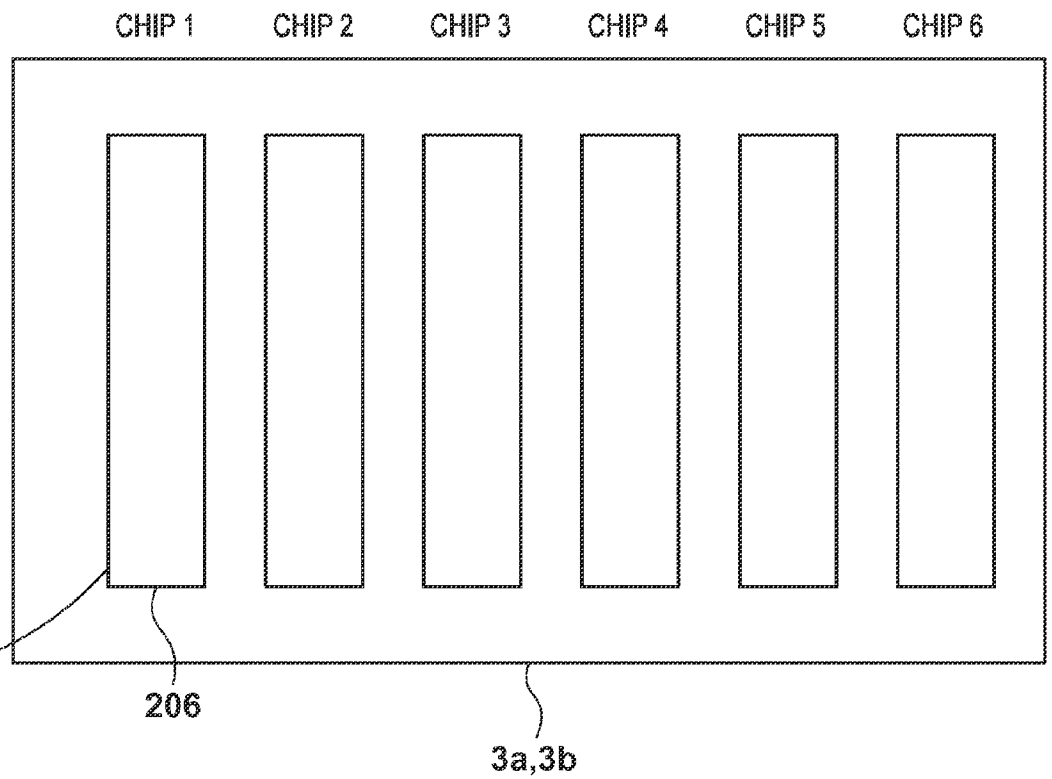
FIGS. 4A and 4B are views showing the arrangement of a printhead (head unit) mounted on the carriage.
Figure 4B:
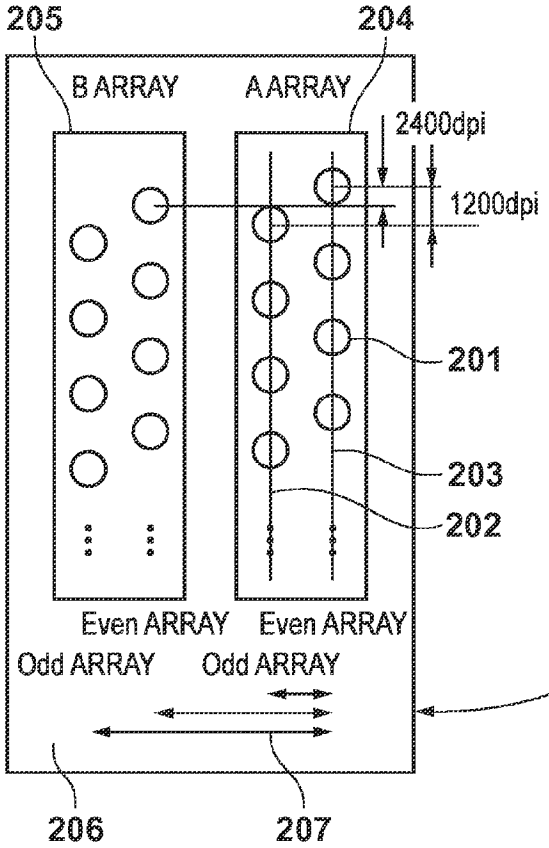

FIGS. 4A and 4B show the arrangement of the printhead (head unit) mounted on the carriage. Note that in FIGS. 4A and 4B, the same reference numerals denote the same components as those described in FIGS. 1A to 3, and a description thereof will not be repeated.

FIG. 4A is a view when the head unit 3*a* (3*b*) is viewed from the ink discharge surface. In the head unit 3*a* (3*b*), six chips (chip1 to chip6) are integrated on its substrate, and can discharge different inks. Note that six chips 206 have the same arrangement. In case of the printing apparatus 2, since the two head units are mounted on the carriage 4, inks of a total of 12 colors can be discharged. These inks include, for example, 12 colors, that is, BK (black), C (cyan), M (magenta), Y (yellow), PC (pale cyan), PM (pale magenta), GY (gray), MBK (pigment black), PGY (pale gray), R (red), G (green), and B (blue).

FIG. 4B shows the detailed arrangement of one chip 206 mounted on the head unit 3*a* (3*b*) when viewed from the ink discharge surface, as in FIG. 4A. FIG. 4B shows the detailed arrangement of arrays of ink discharge nozzles (to be referred to as nozzles hereinafter).

As shown in FIG. 4B, one chip 206 is provided with nozzle arrays including an A array 204 and B array 205. Furthermore, as for each nozzle array, when a plurality of nozzles 201 are numbered in turn from one end toward the other end in the array direction, a nozzle array including nozzles of odd numbers will be referred to as an Odd array 203, and that including nozzles of even numbers will be referred to as an Even array 202. When the head unit 3*a* (3*b*) is mounted on the carriage 4, the arrayed direction of nozzles coincides with the conveyance direction (sub-scanning direction) of the print medium. Also, the arrayed direction of nozzle arrays coincides with the moving direction (main scanning direction) of the carriage. However, the arrayed direction of nozzles need not always be perpendicular to the carriage moving direction, and the arrayed direction of nozzles need only intersect with the carriage moving direction.

A pitch interval between nozzles in the Even and Odd arrays of the A and B arrays is 600 dpi, and nozzles of the Even and Odd arrays in each of the A and B arrays are arranged on the chip while being shifted by half a pitch (that is, 1200 dpi) in their arrayed direction. Furthermore, the A and B arrays are arranged on the chip while being shifted another half pitch (that is, 2400 dpi) in their nozzle array direction. Therefore, as the entire head unit, printing can be executed at a resolution of 2400 dpi in the nozzle array direction.

In this manner, since the nozzle arrays are arranged on the chips while their relative positions are shifted, an image can be formed at a high resolution.

At the time of printing, the respective nozzles are driven at different discharge timings according to a distance 207 between the nozzle arrays, so that inks discharged from nozzles with the same nozzle numbers of the respective nozzle arrays in each chip land at the same position on a print sheet. However, since the distances between these nozzles suffer variations due to manufacturing variations of the printhead, such variations result in shifts of print positions accordingly. The shift amounts of the print positions are also called registration amounts, and a technique for correcting the shift amounts is called registration correction.

<Description of Registration Correction>

In case of reciprocal printing, the registration correction is applied not only to the shift amounts between the nozzle arrays but also to correction of print positions between forward and backward print processes of the printhead. These correction values include some types depending on correction targets.

Registration Correction Type

FIG. 5 shows types of registration correction values.

Respective types will be described below.

1. Even-Odd Array Correction Value

This correction value is used to correct print positions between the Even and Odd arrays. A driving timing of the Odd array is corrected so that an ink droplet discharged from the Odd array matches that discharged from the Even array on the print sheet with reference to the Even array. This correction is applied to each chip, and further applied to each of the A and B arrays. The Even and Odd arrays tend to have different ink discharge velocities, and suffer the influences of height (distance between the discharge surface of the printhead and print sheet) variations.

2. A-B Array Correction Value

This correction value is used to correct print positions between the A and B arrays. This correction is applied to each chip by correcting print positions between Even arrays of the A and B arrays. The Odd arrays can be corrected by adding the A-B array correction value and Even-Odd array correction values of the A and B arrays. Since the A and B arrays have nearly equal discharge characteristics, the influences of height variations are small, and those of position shift factors of nozzle arrays are large.

3. Forward-backward Correction Value

This correction value is used to correct print positions between forward and backward prints. This correction is applied to each chip by correcting print positions by forward print of the Even array of the A array, and those by backward print of the Even array of the A array. Since a discharged ink droplet flies having inertia caused by the carriage moving velocity, the shift amount is influenced by the carriage velocity and flying time.

4. Inter-Chip Correction Value

With reference to one chip, this correction value is used to correct print positions of other chips.

With reference to a chip filled with black ink, print positions by forward print of the Even array of the A array of this chip and those by forward print of the Even array of the A array of the adjustment target chip are corrected. Since a distance between chips is larger than those between the Even and Odd arrays and between the A and B arrays, it is strongly influenced by a slanted attitude of the carriage.

Registration Measurement

Figure 6B:
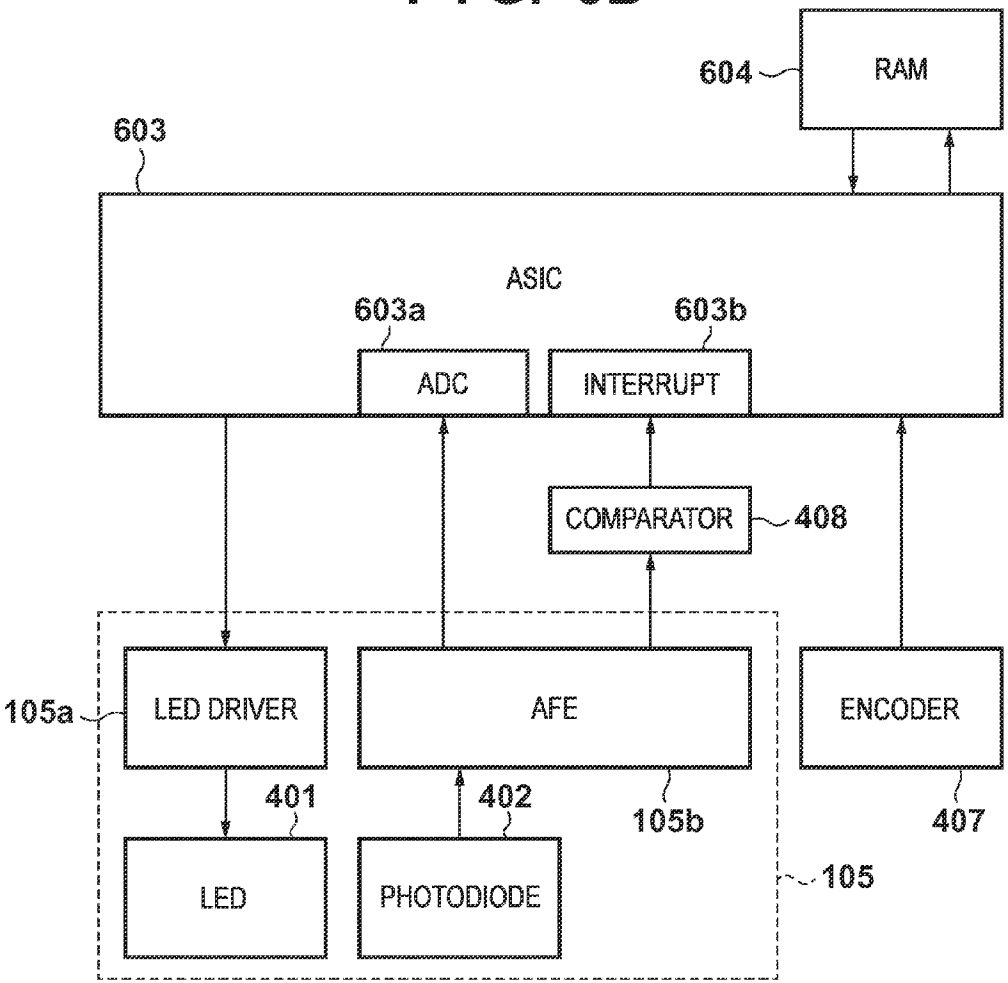
FIGS. 6A and 6B are views showing the arrangement of a reflective-type sensor used in registration measurement and its control arrangement.
Figure 6A:
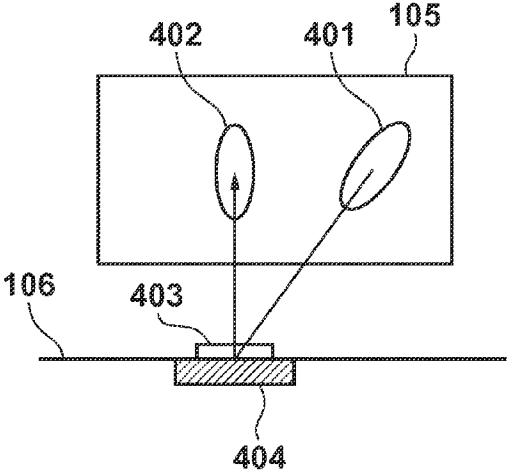

FIG. 6A shows the arrangement of the reflective-type sensor used in registration measurement, and FIG. 6B shows its control arrangement.

As shown in FIG. 6A, the reflective-type sensor 105 includes an LED 401 which irradiates a sheet surface of the print sheet 106 with light, and a photodiode 402 which receives reflected light from the sheet surface. A detection spot 403 is formed so that an irradiation area of irradiation light and a detection area on the light-receiving side overlap each other on a reflection surface, and has a size of 5 mm×5 mm. When a pattern 404 formed on a sheet surface is irradiated with light, a level of a reflection intensity that reflects a patch density can be detected. The reflection intensity on a white sheet surface is strong, and that on a patch having a high density is weak.

As shown in FIG. 6B, in the printing apparatus 2, the ASIC 603 controls the operation of the reflective-type sensor 105. The LED 401 can selectively emit three primary colors; that is, R (red), G (green), and B (blue), and is controlled by an LED driver 105*a* based on a patch color to be detected. A received light signal from the photodiode 402 undergoes signal amplification processing, low-pass filter processing for noise reduction, and the like in an analog processor (AFE: analog frontend) 105*b*.

An analog signal processed in this way is input to the ASIC 603 as a digital signal via an ADC (A/D converter) 603*a* of the ASIC 603. Also, that analog signal is input to a comparator 408, and a comparator output is input to an interrupt port 603*b* of the ASIC 603 as an interrupt signal. Furthermore, a signal from an encoder 407 used to detect the position of the carriage 4 is also input to the ASIC 603.

The ASIC 603 synchronizes the output signal from the reflective-type sensor 105 and the position signal from the encoder 407 in cooperation with the MPU 601, and processes the signal from the reflective-type sensor 105 as a density detection signal corresponding to the position of the carriage 4. The RAM 604 is connected to the ASIC 603, and stores read patch data, a count value output from the encoder, and the like.

Figure 7B:
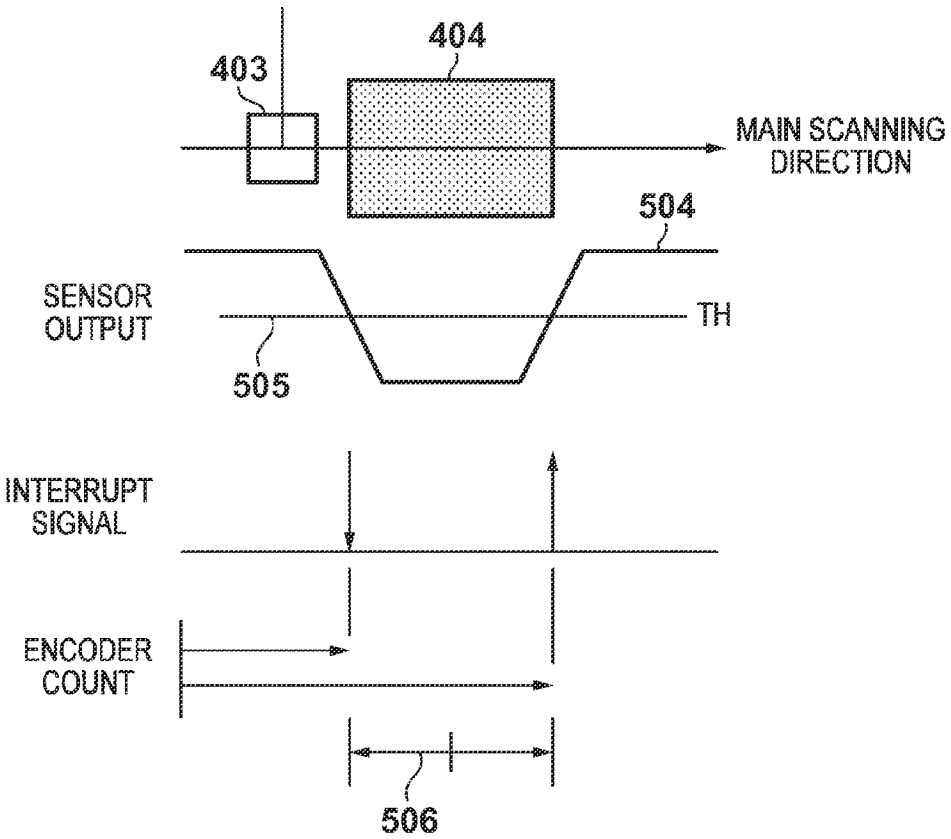
FIGS. 7A and 7B are views showing a pattern used in registration measurement.
Figure 7A:
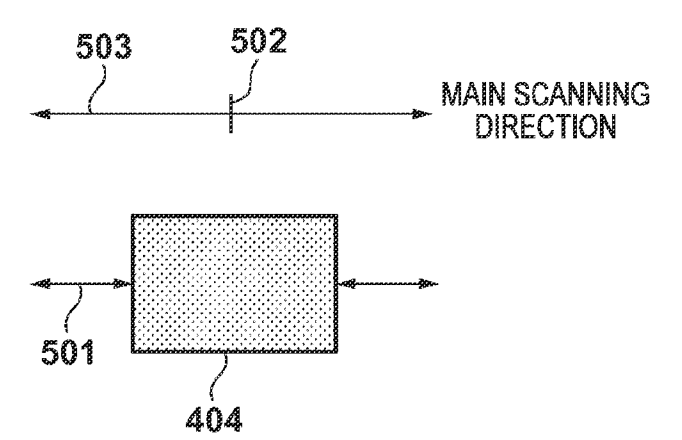

FIGS. 7A and 7B show a pattern used in registration measurement.

As shown in FIG. 7A, the pattern 404 has a rectangular shape and uniform density. The length in the main scanning direction of the pattern is longer than at least the detection spot 403 of the reflective-type sensor 105. Also, the length in the sub-scanning direction is larger than the detection spot 403 to have a sufficient margin. The pattern has the rectangular shape since it has edges perpendicular to the carriage scanning direction so as to sharpen a signal leading edge at the time of detection. Since a higher pattern density enhances a signal contrast, a high-density pattern having a uniform density is used.

The pattern 404 is formed by discharging ink so that a target position 502 in the main scanning direction by the reflective-type sensor 105 matches the pattern center, but it is usually formed at a shifted position due to registration. A spacing 501 between neighboring patterns is set to have a sufficient margin with respect to that expected shift. At the time of pattern detection, a pattern position is detected within a detection range 503 having the target position 502 as the center.

FIG. 7B shows a change in detection signal in the main scanning direction when the pattern 404 is detected by the reflective-type sensor 105. FIG. 7B shows a change in detection signal with reference to the central position of the detection spot 403. According to this change, an intensity of a detection signal 504, which is detected when the pattern 404 enters the detection spot 403, is decreased, and becomes stable at a uniform level when the full spot is included in the pattern 404. In this case, the comparator 408 compares the detection signal 504 with a threshold 505, and generates an interrupt signal when the intensity of the detection signal 504 falls below the threshold (TH) 505. Note that the threshold 505 is set to be 50% of the pattern density. The threshold may be calculated by measuring the pattern density in advance.

The ASIC 603 acquires the carriage position measured by the encoder 407 at that timing according to the interrupt signal. Since the pattern 404 is detected while the carriage 4 is moved, two points of edge positions on the two sides of the patch of the pattern can be detected. This position detection resolution is decided by the resolution of slits provided to the scale 103, but the resolution may be multiplied by temporally dividing a signal from the encoder. A pattern central position 506 of the detected two points of the edge positions is set as a patch position. Thus, position shift influences when the detection signal exceeds the threshold and when it falls below the threshold can be avoided.

Factor of Influence on Registration

In order to calculate an optimal registration correction value from the measured registration amount, various factors have to be taken into consideration.

Figures 8A, 8B, 8C:
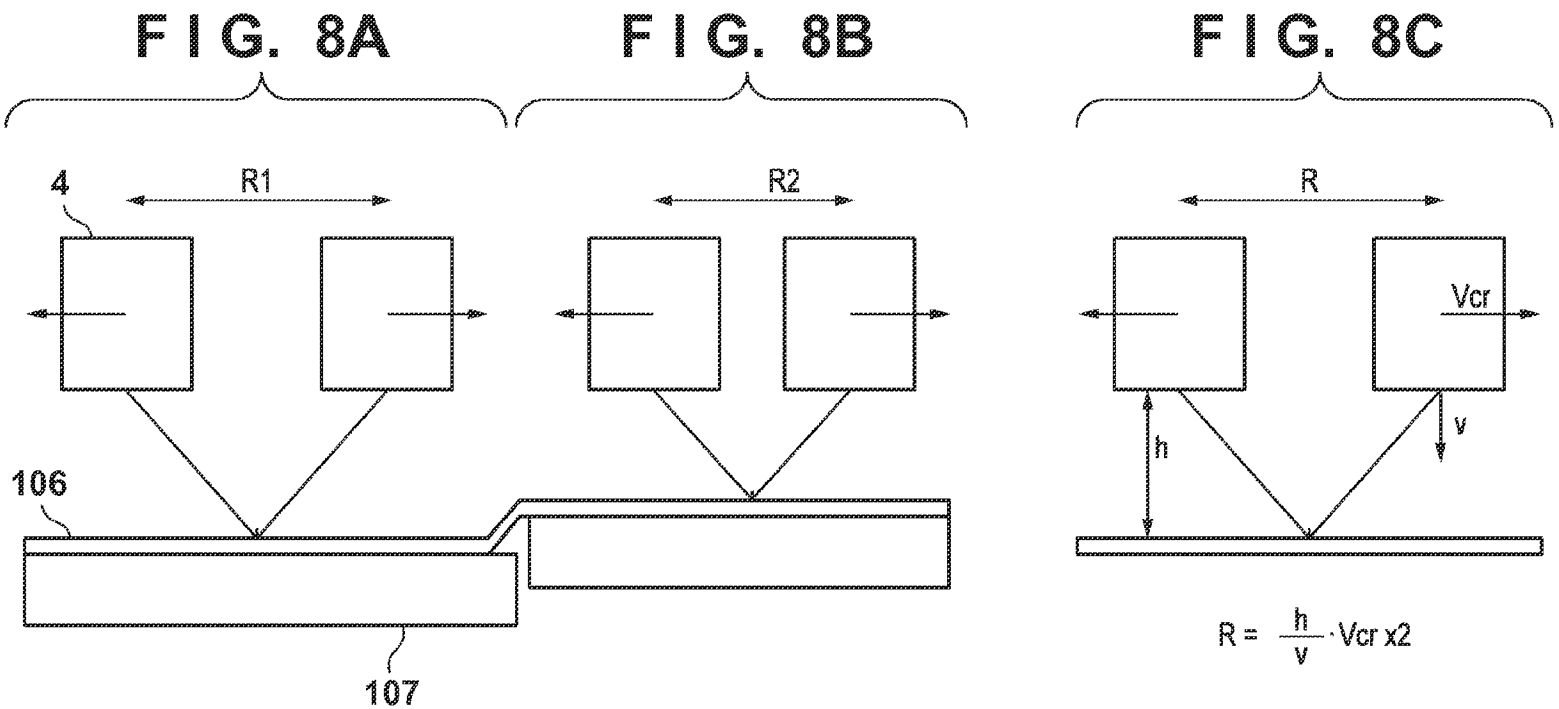
FIGS. 8A, 8B, and 8C are views showing influences caused by changes of distances between a discharge surface of the printhead and a print sheet.

(1) Influence of Height (Distance Between Discharge Surface of Printhead and Print Sheet) Variation FIGS. 8A to 8C show the influence caused by a change in distance between the discharge surface of the printhead and print sheet.

This distance variation is caused by attachment variations of the platen 107. This distance variation especially influences registration values in reciprocal print. A discharged ink droplet flies to have a velocity component in the carriage scanning direction by inertia from the carriage 4, and its flying time is decided based on the distance between the discharge surface of the printhead and print sheet.

On the other hand, as can be seen from FIG. 3, when the platen adopts the divisional configuration, the distance between the discharge surface of the printhead and print sheet varies due to the attachment variations of the platen 107 during movement of the carriage 4, as shown in FIGS. 8A and 8B.

Since a distance in the case shown in FIG. 8B is shorter than that in the case shown in FIG. 8A, a flying time of an ink droplet in the case shown in FIG. 8B is shorter. In this case, differences R1 and R2 between print positions in forward and backward print operations satisfy R2<R1. That is, the forward-backward correction value has to be decreased.

In FIG. 8C, letting v be a discharge velocity of an ink droplet, Vcr be a velocity of the carriage, h be a distance between the discharge surface of the printhead and print sheet, and R be a shift amount of print positions between forward and backward print operations, their relationship can be expressed by:

$$R=h/v\cdot Vcr\times 2 \quad (1)$$

As described by equation (1), a variation of the distance h influences the shift amount R during reciprocal print operations. Since this variation mainly depends on the platen, it is generated depending on the carriage position in the main scanning direction when viewed from the carriage.

(2) Attitude Variation of Carriage

The carriage 4 is moved along a rail arranged along the main scanning direction. However, when the rail is curved, an attitude of the carriage is slanted.

Figure 9:
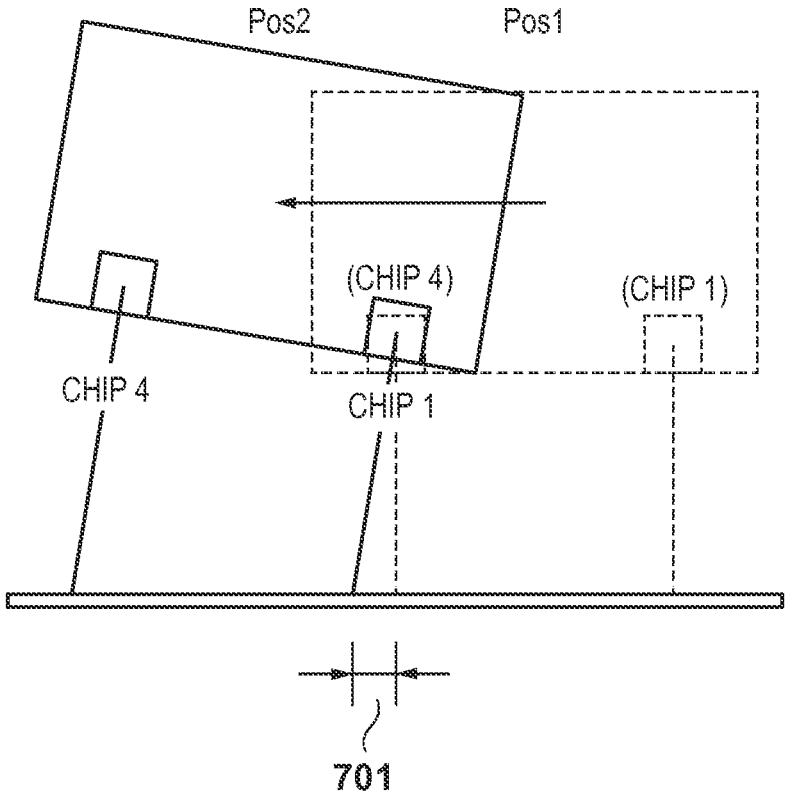
FIG. 9 is a view showing an influence of slanting of the carriage on printing.

FIG. 9 shows the influence of slanting of the carriage on printing.

FIG. 9 shows a case in which the attitude is slanted when the carriage 4 is moved from Pos1 to Pos2. When chip4 discharges ink at Pos1, and when the carriage is moved to Pos2 to match the former print position and chip1 discharges ink, since the attitude of the carriage at Pos2 is different from that at Pos1, a discharge direction is also different, and a print position is shifted. This shift is denoted by reference numeral 701 in FIG. 9. This influence particularly appears in an inter-chip correction value with a long nozzle array distance. This variation also depends on the scanning rail of the carriage, and depends on the carriage position in the main scanning direction.

A pattern used in registration adjustment applied to the printing apparatus with the aforementioned arrangement will be described below.

Figure 10:
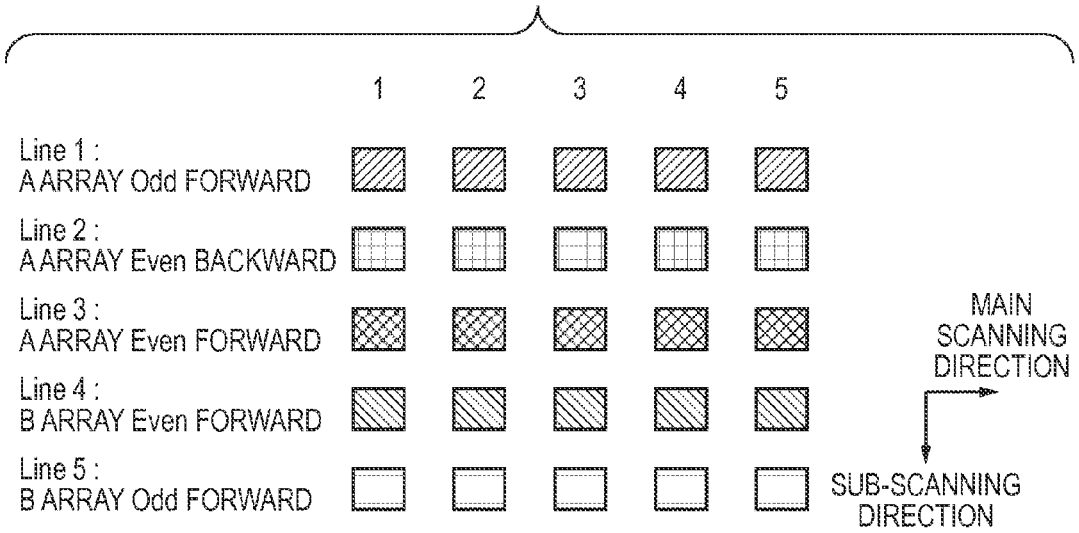
FIG. 10 is a view showing a layout of patterns each including a plurality of patches.

FIG. 10 shows a layout of patterns each including a plurality of patches.

In FIG. 10, the patterns have different formation conditions (types) for respective lines. That is, Line1 is used in forward print by the Odd array of the A array, Line2 is used in backward print by the Even array of the A array, Line3 is used in forward print by the Even array of the A array, Line4 is used in forward print by the Even array of the B array, and Line5 is used in forward print by the Odd array of the B array. In other words, the types of patterns are distinguished from each other by print directions, nozzle arrays to be used, and nozzles to be used.

In each line, five patches are formed, and are laid out so that printed positions in the main scanning direction match in the vertical direction. Line1 to Line5 of the pattern are formed without conveying a print sheet. In this case, the pattern may be formed by a plurality of scans of the printhead, and in this example, it is formed by four reciprocal scans without conveying a print sheet.

Figure 11:
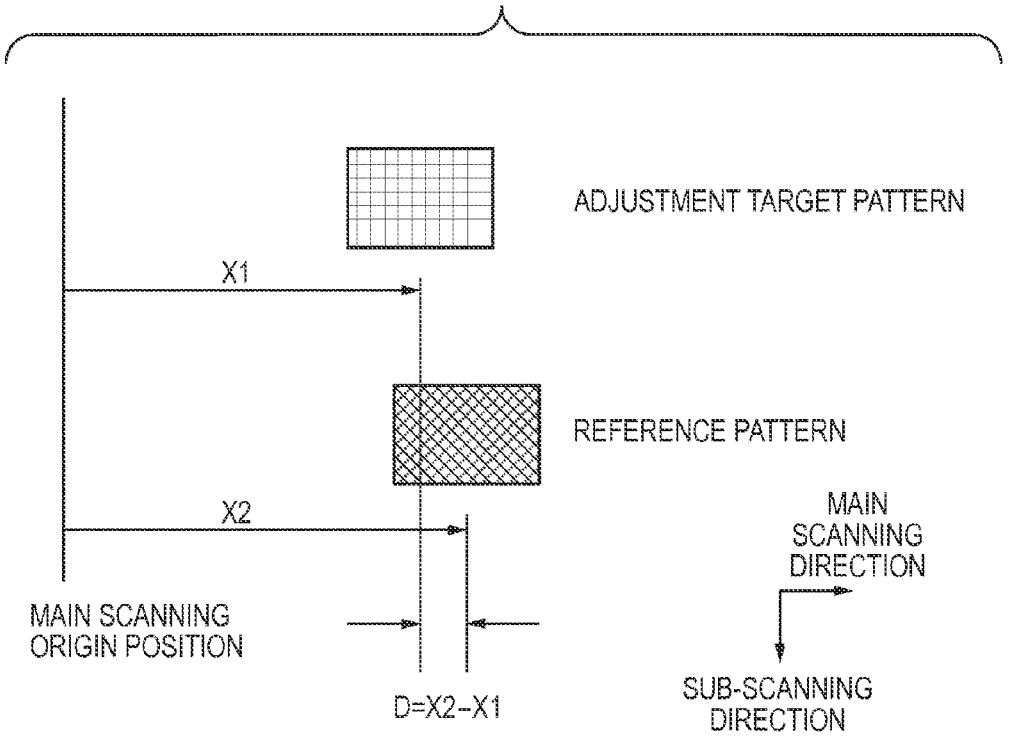
FIG. 11 is a view illustrating a registration correction value calculation method.

FIG. 11 illustrates a registration correction value calculation method.

A correction value between patterns is decided by comparing detected patch central positions between two lines. At a position in the main scanning direction with reference to an origin position in the main scanning direction, letting X1 be a position of an adjustment target pattern and X2 be a position of a reference pattern, a shift D between the patterns is given by D=X2−X1. In this case, by setting a correction value P=D, and executing printing by adding P upon printing under the condition adjusted using the adjustment target pattern, printing can be performed at a position that matches X2 in the example of FIG. 11. Since the reference pattern used for the purpose of comparison of positions is formed at nearly the same position and is compared, the influence of external disturbances caused by the position in the main scanning direction, which have been described with reference to FIGS. 8A to 9, can be eliminated.

Figure 12B:
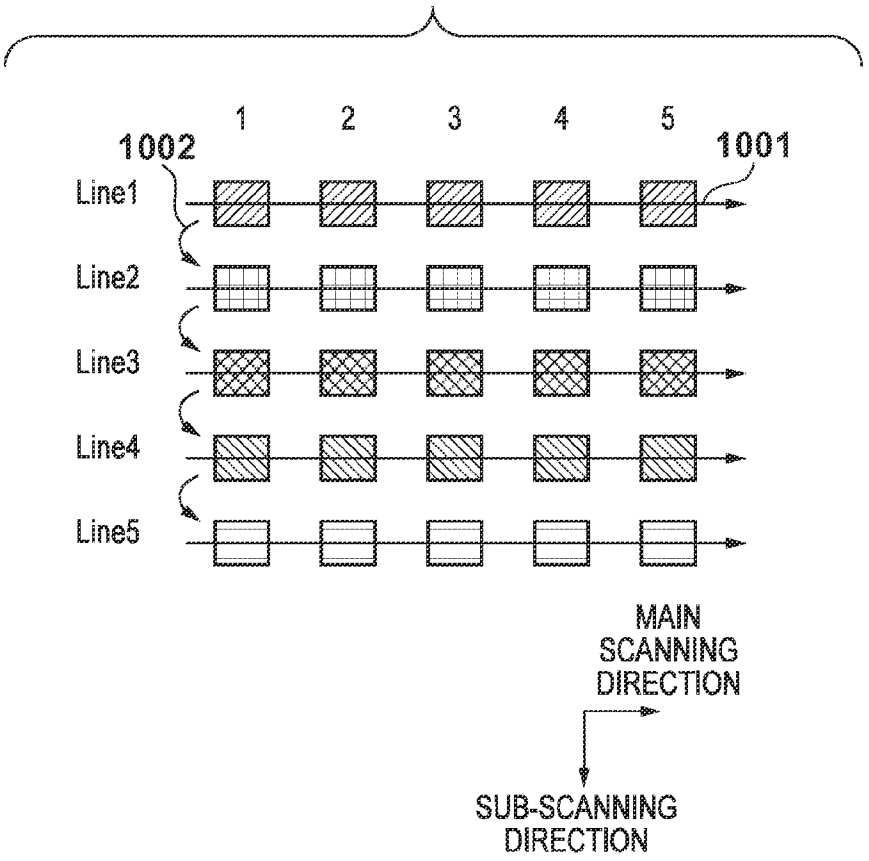
FIGS. 12A and 12B are views for explaining patch position calculation processing and showing patterns used for the calculation.
Figure 12A:
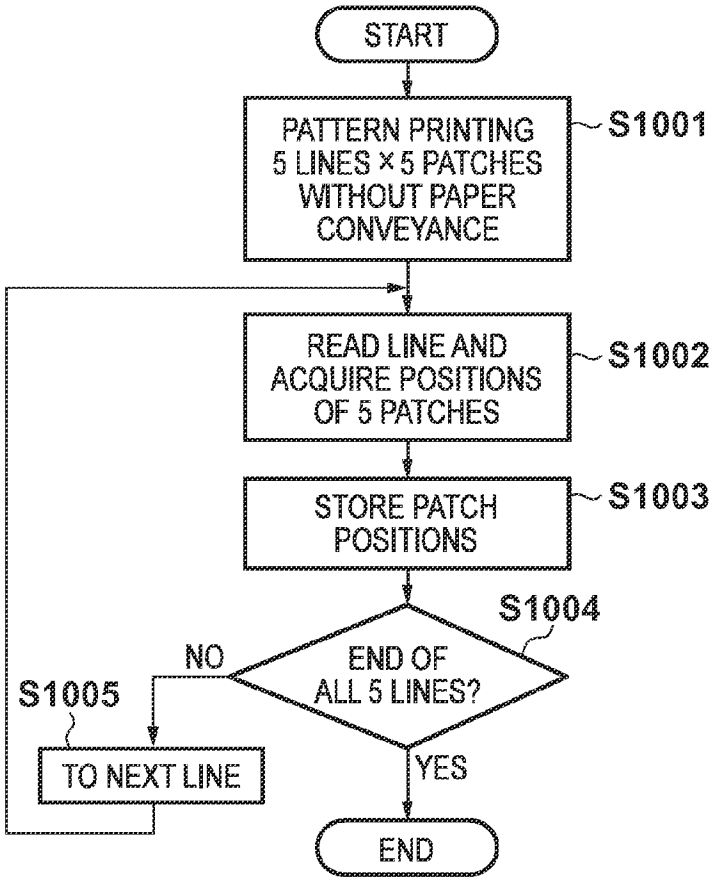

FIGS. 12A and 12B are views for explaining patch position calculation processing and showing patterns used for the calculation processing. Note that FIG. 12A shows the flowchart of the patch position calculation processing, and FIG. 12B shows the patterns.

In step S1001, patterns are formed. In this case, patterns for five lines are formed without conveying a print sheet. In this case, print scans themselves may be divided. In this example, patterns are formed by four reciprocal scans. The reason why the print sheet is not conveyed is to prevent formation positions of patterns from being shifted due to skewed conveyance at the time of conveyance.

In step S1002, the printed patterns are read by a forward scan of the carriage, as indicated by an arrow 1001 in FIG. 12B. In this case, the print sheet is conveyed to match the detection spot of the reflective-type sensor 105, thereby reading a pattern for one line. Since each line includes five patches, their patch positions are acquired. Assume that the pattern central position 506 is detected as each patch position, as shown in FIG. 7B.

In step S1003, the acquired patch positions are stored in the RAM 604. In this case, the patch positions are stored in association with patch numbers.

It is checked in step S1004 whether or not reading of all the five lines is complete. If reading is not complete yet, the process advances to step S1005 to select the next line as a reading position. The process then returns to step S1002 to read the next line. In this manner, the processes of steps S1002 to S1005 are repeated until reading of all the five lines is complete. For this purpose, as indicated by arrows 1002 in FIG. 12B, every time reading of one line is complete, the next line is selected, and reading in the line direction is repeated.

Next, the registration correction value is calculated based on the acquired patch positions.

Figure 13A:
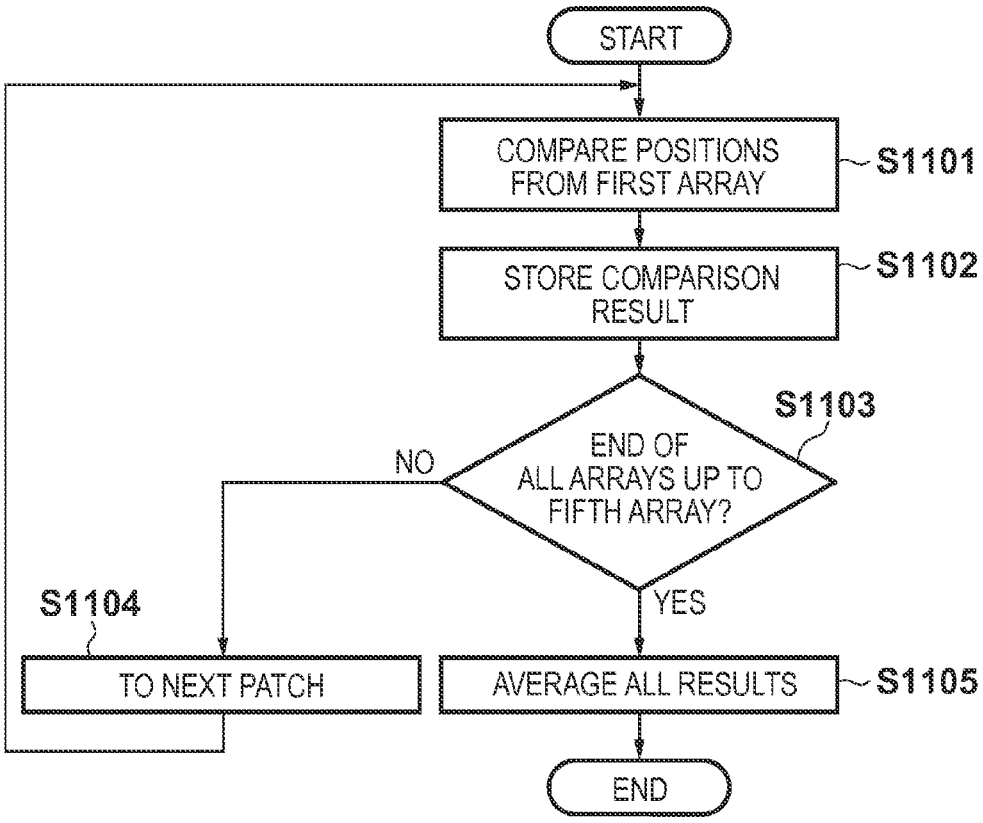
FIGS. 13A, 13B, and 13C are views for explaining registration correction value calculation processing, showing patterns used for the calculation, and showing pattern central positions of patches.
Figure 13B:
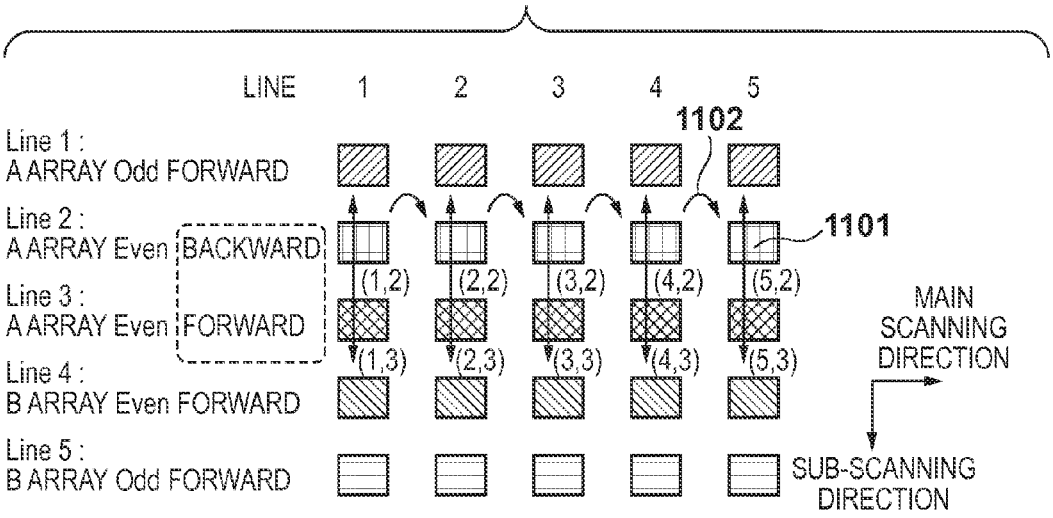
Figure 13C:
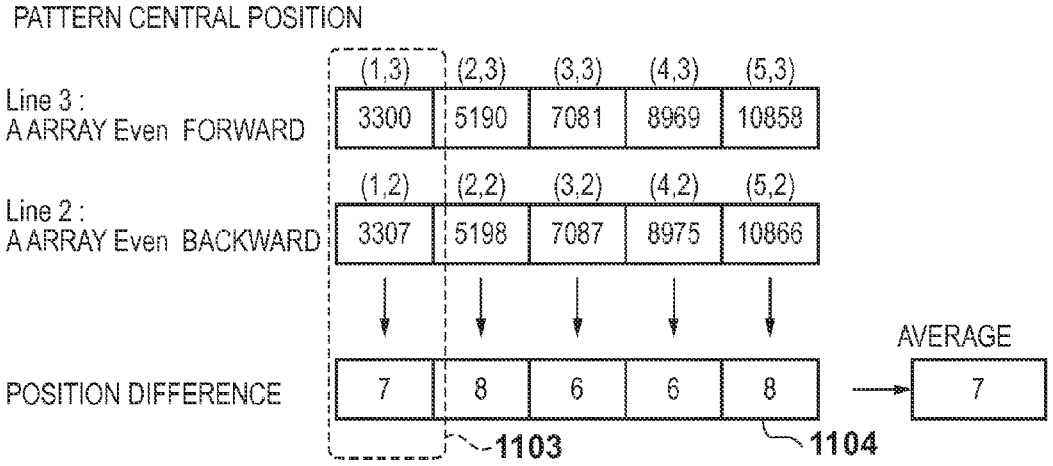

FIGS. 13A to 13C are views for explaining registration correction value calculation processing, showing patterns used for the calculation processing, and showing pattern central positions of patches. FIG. 13A shows the flowchart of the registration correction value calculation processing, FIG. 13B shows the patterns, and FIG. 13C shows pattern central positions. A case will be exemplified below wherein a forward-backward correction value is calculated, but the same applies to other correction values.

Pattern formation conditions are as shown in FIG. 13B, and a forward-backward correction value is calculated based on pattern position detection results of Line3 formed by forward print and Line2 formed by backward print.

In step S1101, positions are compared in association with a patch array having a vertically arranged relationship 1101 shown in FIG. 13B. A comparison result of the first array is as denoted by reference numeral 1103 in FIG. 13C. Positions are compared based on patch central positions. Since a patch formed by forward print is compared as a reference, a position of a patch (1, 3) is subtracted from that of a patch (1, 2) to calculate a difference. In step S1102, a result 1104 in FIG. 13C is stored in the RAM 604.

It is checked in step S1103 whether or not correction value calculations for all the five patches are complete. If the calculations are not complete yet, the process advances to step S1104 to select the next patch as a calculation target as indicated by an arrow 1102. Then, the process returns to step S1101 to make a calculation based on the next patch. In this manner, the processes of steps S1101 to S1104 are repeated until the calculations of all the five patches are complete.

After the differences of the positions for the five patches are calculated in this way, the process advances to step S1105, and the storage results of the differences of the positions for the five patches are read out and averaged, thus calculating a correction value.

By calculating the correction value in this way, the influences of external disturbances generated depending on the position in the main scanning direction are eliminated, thus obtaining a more suitable correction value.

Next, ink discharge timings in reciprocal print processes are adjusted based on the obtained forward-backward correction value. In ink discharge operations, discharge pulses are generated based on position signals from the encoder so that ink droplets are attached to targeted print positions.

For example, assume that backward print is shifted to the home position (HP) side of the carriage with respect to forward print, and the forward-backward correction value is +5. Based on this correction value, the forward-backward correction value is applied to backward print so as to be matched with a print position in forward print. When the carriage reaches a delayed position in correspondence with the forward-backward correction value=+5 compared to the ink discharge position in forward print, a discharge pulse is generated so as to allow an ink droplet by backward print to be attached on a position shifted to the HP side. Since the carriage is moved to approach the HP side in backward print, an ink droplet, which is discharged at a delayed timing in correspondence with the forward-backward correction value=+5, is attached on a position shifted to the HP side. As a result, the print position in the backward direction matches that in the forward direction.

In consideration of the structure of the pockets of the carriage 4 on which the head units shown in FIG. 3 are mounted, the head units may often be attached to have a slanted attitude due to allowance of the pockets when the head units are attached to the pockets. A shift caused by such attachment will be referred to as head slanting hereinafter. When head slanting has occurred, the nozzle array direction is not perpendicular to the main scanning direction and is slanted. As a result, patches are printed to be shifted in the conveyance direction of a print sheet, in other words, in the line direction of the pattern to be formed.

Figures 14, 15:
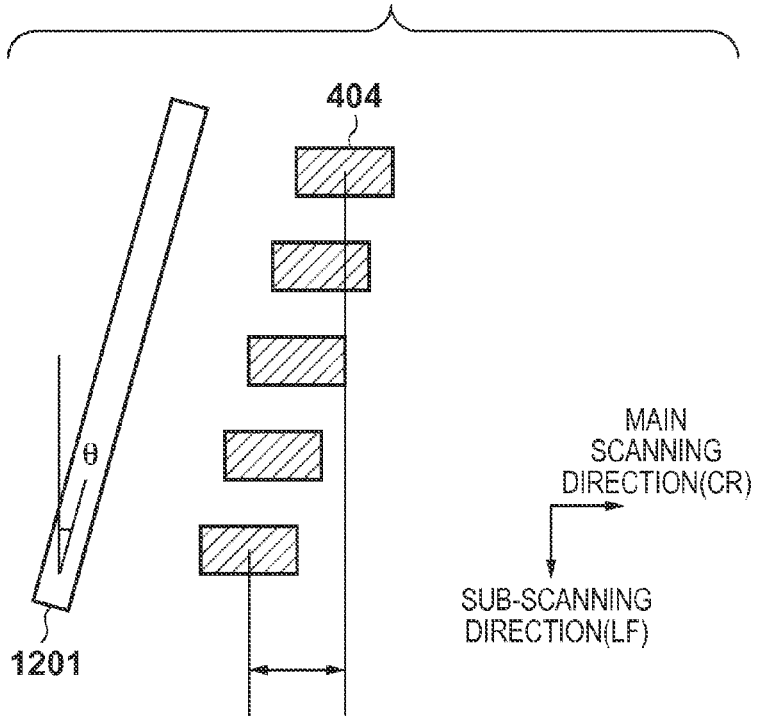
FIG. 14 is a view showing a layout of patches on which the influence of head slanting appears.
FIG. 15 is a table showing how to select a reference pattern and adjustment target pattern according to a correction value calculation target.

FIG. 14 is a view showing a layout of patches on which the influence of head slanting appears.

As shown in FIG. 14, when a nozzle array 1201 is slanted to have an angle θ with respect to the sub-scanning direction, a pattern is formed while reflecting that slanting angle. In this case, a sine component of the slanting angle (θ) appears in the main scanning direction, and is detected as a position shift in the main scanning direction.

In order to eliminate the influence of such head slanting, this embodiment uses neighboring patterns so as not to increase an interval in the nozzle array direction between reference and adjustment patterns between conditions for correction value calculation targets.

FIG. 15 is a table showing how to select a reference pattern and adjustment target pattern according to a correction value calculation target.

According to FIG. 15, a neighboring reference pattern and adjustment target pattern are selected so as not to increase an interval in the nozzle array direction between these patterns. That is, neighboring patterns in the line direction are selected, or a difference in the line direction is reduced. Furthermore, by mixing the Even-Odd array correction value (B array) having the Even array of the B array as a reference, the difference in the line direction for each reference pattern is reduced. By laying out patterns in this manner, the influence of head slanting can be eliminated, and a more suitable correction value can be obtained.

Figure 16A:
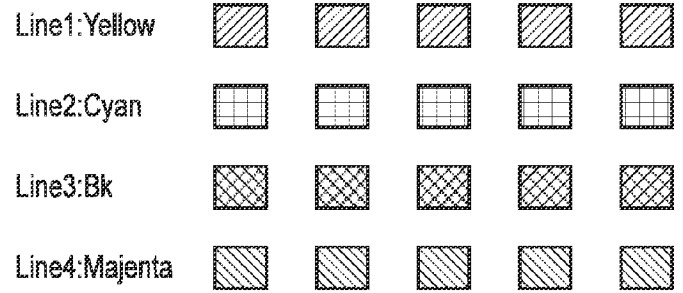
FIGS. 16A and 16B are views showing inter-chip correction value adjustment patterns.
Figure 16B:
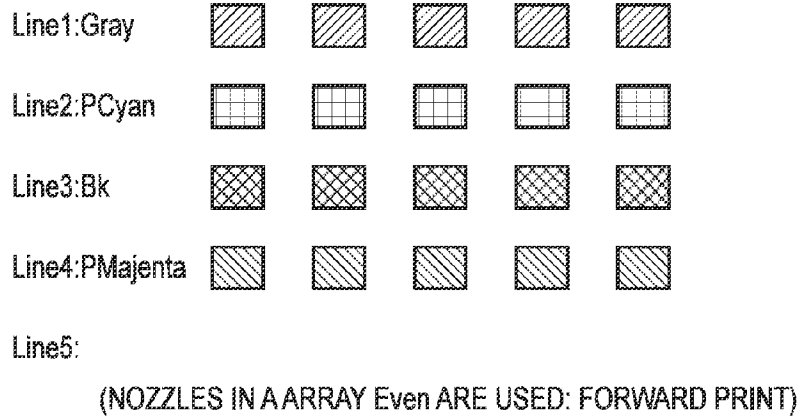

FIGS. 16A and 16B show adjustment patterns of an inter-chip correction value.

FIGS. 16A and 16B show different patterns. When an inter-chip correction value of printing of cyan (C) ink with respect to that of black (BK) ink is to be adjusted, positions of Line3 and Line2 are compared. Details of the patch position calculation processing and correction value calculation processing are the same as those described using FIGS. 12A to 13C.

In the above description, patterns are formed without conveying a print sheet. However, the relationship between patterns to be compared is satisfied even in a case where conveyance of a print sheet is made.

Especially, since the printing apparatus shown in FIGS. 1A and 1B uses the two head units, a variation range of correction values is large. In particular, an inter-chip correction value suffers a large variation since it is used between the two head units.

Figure 17:
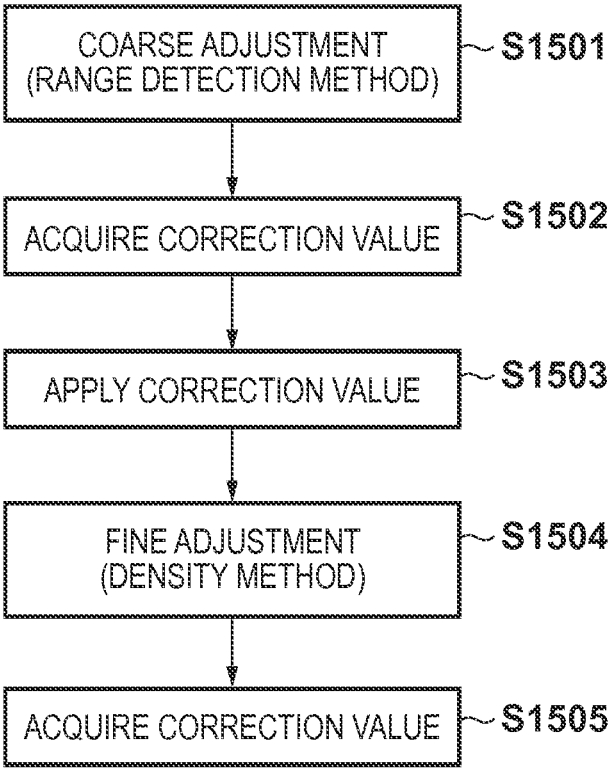
FIG. 17 is a flowchart showing two steps of adjustment processes.
Figure 18A:
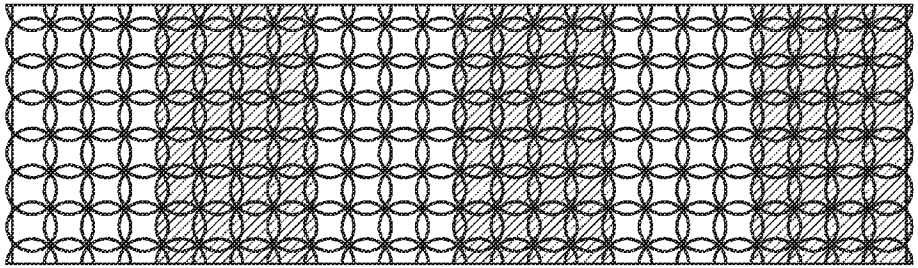
FIGS. 18A, 18B, and 18C are explanatory views of patterns which are disclosed in Japanese Patent Laid-Open No. 2000-37936, and in which four dots and a blank area for four dots are periodically repeated in the main scanning direction.
Figure 18B:
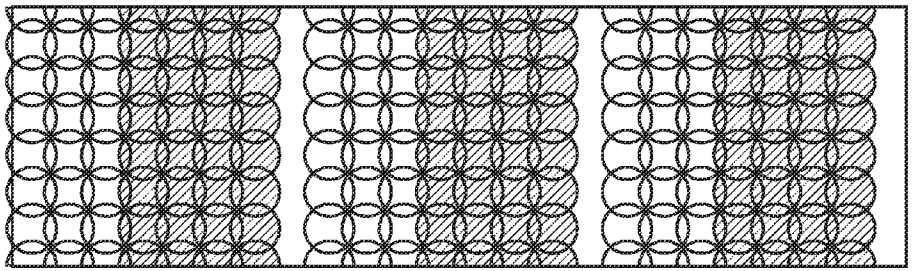
Figure 18C:
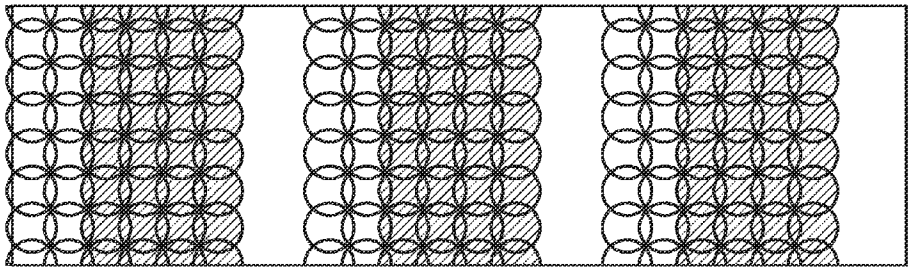
Figure 19A:
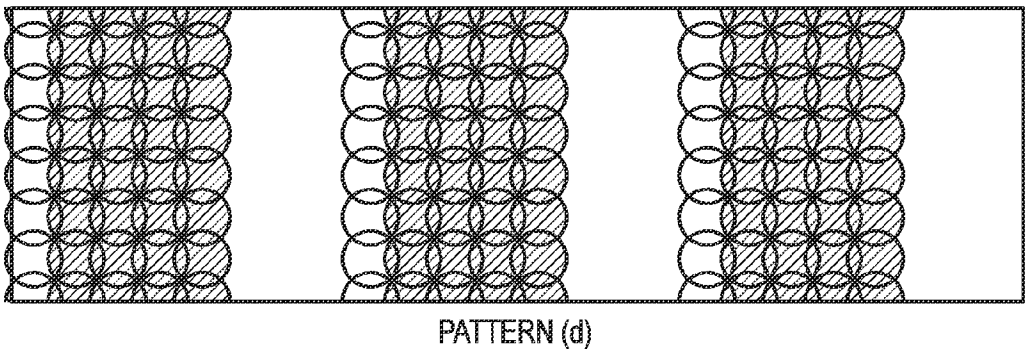
FIGS. 19A, 19B, and 19C are explanatory views of patterns which are disclosed in Japanese Patent Laid-Open No. 2000-37936, and in which four dots and a blank area for four dots are periodically repeated in the main scanning direction.
Figure 19B:
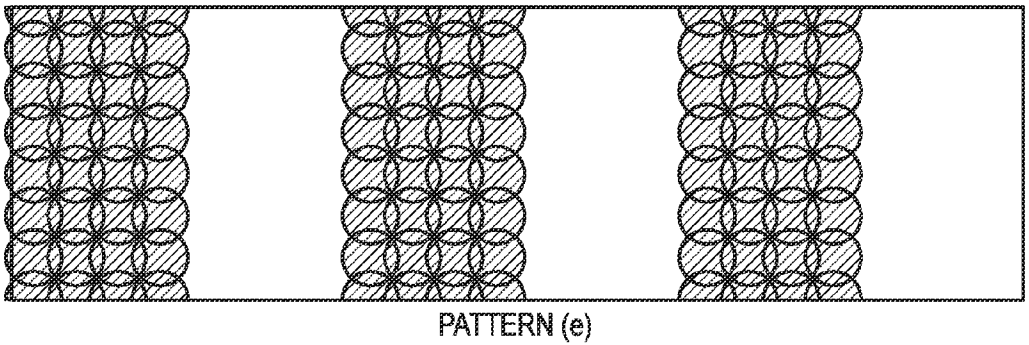
Figure 19C:
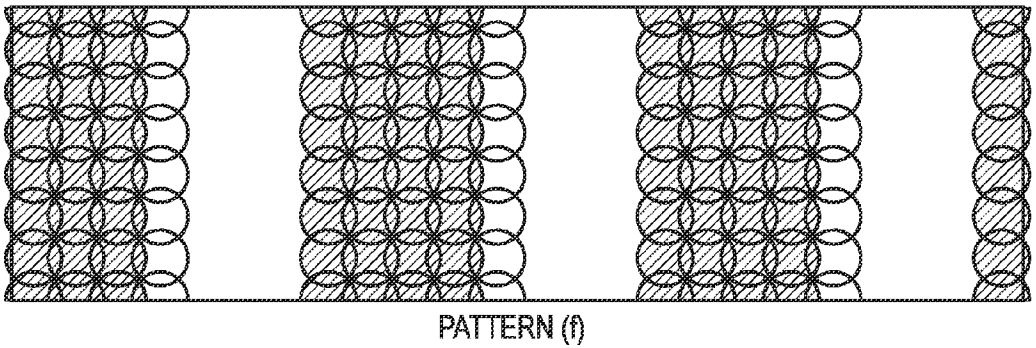
Figure 20A:
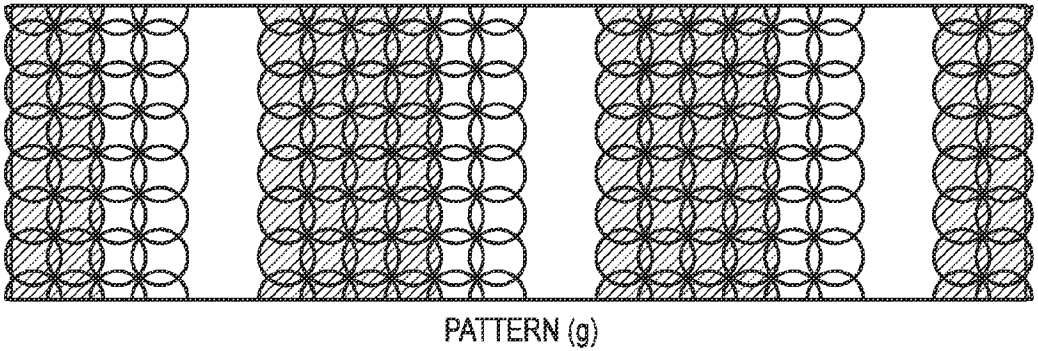
FIGS. 20A, 20B, and 20C are explanatory views of patterns which are disclosed in Japanese Patent Laid-Open No. 2000-37936, and in which four dots and a blank area for four dots are periodically repeated in the main scanning direction.
Figure 20B:
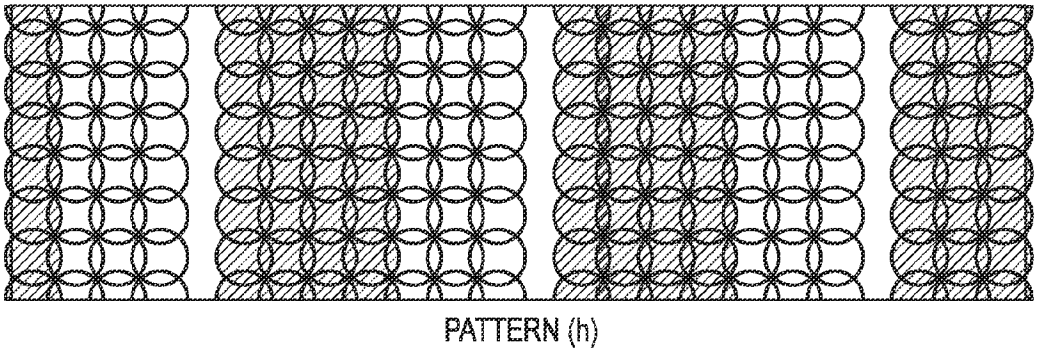
Figure 20C:
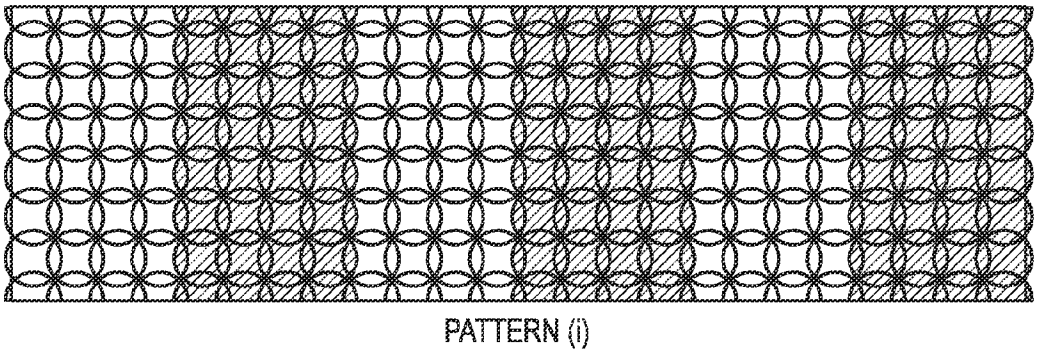

For this reason, this embodiment executes two-step adjustment processing shown in FIG. 17.

Referring to FIG. 17, in step S1501, adjustment (coarse adjustment) according to the range detection method (first adjustment method) having a broad adjustment range of the registration correction value is executed. In this adjustment, adjustment patterns shown in FIG. 10 are printed on a print sheet (first pattern print), and are read using the reflective-type sensor (first reading), thus executing the adjustment method described using FIGS. 12A to 12C. Then, a correction value is acquired in step S1502, and is applied to the printing apparatus in step S1503.

After that, in step S1504, adjustment (fine adjustment) according to the density method (second adjustment method), which has a narrow adjustment range of a correction value but assures high adjustment precision is executed. In this fine adjustment, adjustment patterns are printed again by the coarse-adjusted printing apparatus (second pattern print), and are read by the reflective-type sensor (second reading), thus executing the fine adjustment. In this manner, in step S1505, a final correction value to which the results of the two adjustment methods are reflected is calculated.

Note that the density method disclosed in, for example, Japanese Patent Laid-Open No. 2000-37936 or the like can be used.

According to Japanese Patent Laid-Open No. 2000-37936, adjustment between forward and backward print processes in reciprocal print processes is executed. In forward printing, the printhead as a processing target is appropriately driven to form, for eight patches, patch elements having a pattern in which four dots and a blank area for four dots are repeated by a predetermined width in turn from a left-end pixel array as an absolute position reference of each patch to the right in the main scanning direction.

Next, in backward print, the printhead as the processing target is appropriately driven to form the following sample patches SP1 to SP8. That is, these sample patches include:

SP1: a patch in which four dots and a blank area for four dots are repeated by a predetermined width in turn from the fifth pixel on the right side of the left-end pixel array as the absolute position reference of the patch in the right direction;

SP2: a patch in which four dots and a blank area for four dots are repeated by a predetermined width in turn from the fourth pixel on the right side of the left-end pixel array as the absolute position reference of the patch in the right direction;

SP3: a patch in which four dots and a blank area for four dots are repeated by a predetermined width in turn from the third pixel on the right side of the left-end pixel array as the absolute position reference of the patch in the right direction;

SP4: a patch in which four dots and a blank area for four dots are repeated by a predetermined width in turn from the second pixel on the right side of the left-end pixel array as the absolute position reference of the patch in the right direction;

SP5: a patch in which four dots and a blank area for four dots are repeated by a predetermined width in turn from the first pixel on the right side of the left-end pixel array as the absolute position reference of the patch in the right direction;

SP6: a patch in which four dots and a blank area for four dots are repeated by a predetermined width in turn from the left-end pixel array as the absolute position reference of the patch in the right direction;

SP7: a patch in which four dots and a blank area for four dots are repeated by a predetermined width in turn from the first pixel on the left side of the left-end pixel array as the absolute position reference of the patch in the right direction; and SP8: a patch in which four dots and a blank area for four dots are repeated by a predetermined width in turn from the second pixel on the left side of the left-end pixel array as the absolute position reference of the patch in the right direction.

That is, the sample patches SP1 to SP8 correspond to a pattern formed by superposing patch elements which are formed in a forward path and in which a four-dot forming area and blank area for four dots are repeated, and patch elements which are formed in a backward path and in which a four-dot forming area and blank area for four dots are repeated while being shifted by one dot. This pattern can be formed by shifting print timings or shifting print data.

Then, intensities of reflected light of these sample patches are measured using the optical sensor included in the carriage, and a function required to calculate a relative print shift amount is calculated from a relative relationship of these values.

Processing for calculating that function will be described in detail below.

FIGS. 18A to 18C, FIGS. 19A to 19C, and FIGS. 20A to 20C are explanatory views of patterns in which four dots and a blank area for four dots are periodically repeated. A blank dot indicates a dot formed on a print medium in a forward scan, a hatched dot indicates a dot formed in a backward scan. In these figures, dots are discriminated by hatching for the sake of simplicity, but these dots are formed by ink discharged from the single printhead and do not correspond to color tones (colors or densities).

These figures show dots when print positions are matched in the forward and backward scans, and patterns (a) to (g) in these figures respectively correspond to the sample patches SP2 to SP8. Also, a pattern (h) corresponds to the sample patch SP1 or a patch in which four dots and a blank area for four dots are repeated by a predetermined width in turn from the third pixel on the left side of the left-end pixel array as the absolute position reference of the patch in the right direction with respect to the patch element in the forward path. Also, a pattern (i) corresponds to a patch in which four dots and a blank area for four dots are repeated by a predetermined width in turn from the fourth pixel on the left side of the left-end pixel array as the absolute position reference of the patch in the right direction with respect to the patch element in the forward path. For this patch, the optical sensor measures the same density equal to that of the pattern (a).

According to this measurement, since a print area ratio of the pattern (e) is minimum, a maximum reflected light intensity is obtained. Also, since a print area ratio of the patterns (a) and (i) is maximum, a minimum reflected light intensity is obtained. Then, the density measurement results of the sample patches SP1 to SP8 formed by an actual printing apparatus are more likely to be scattered in states among the patterns (a) to (i).

Processing for an example of the density measurement results of the sample patches SP1 to SP8 will be described below with reference to FIG. 21. This example is an example in which print area ratios are obtained as a result of formation of sample patches by a printing apparatus as a processing target.

As can be seen from the patterns shown in FIGS. 18A to 20C, print area ratios of the sample patches SP1 to SP8 have a periodicity.

Figure 21:
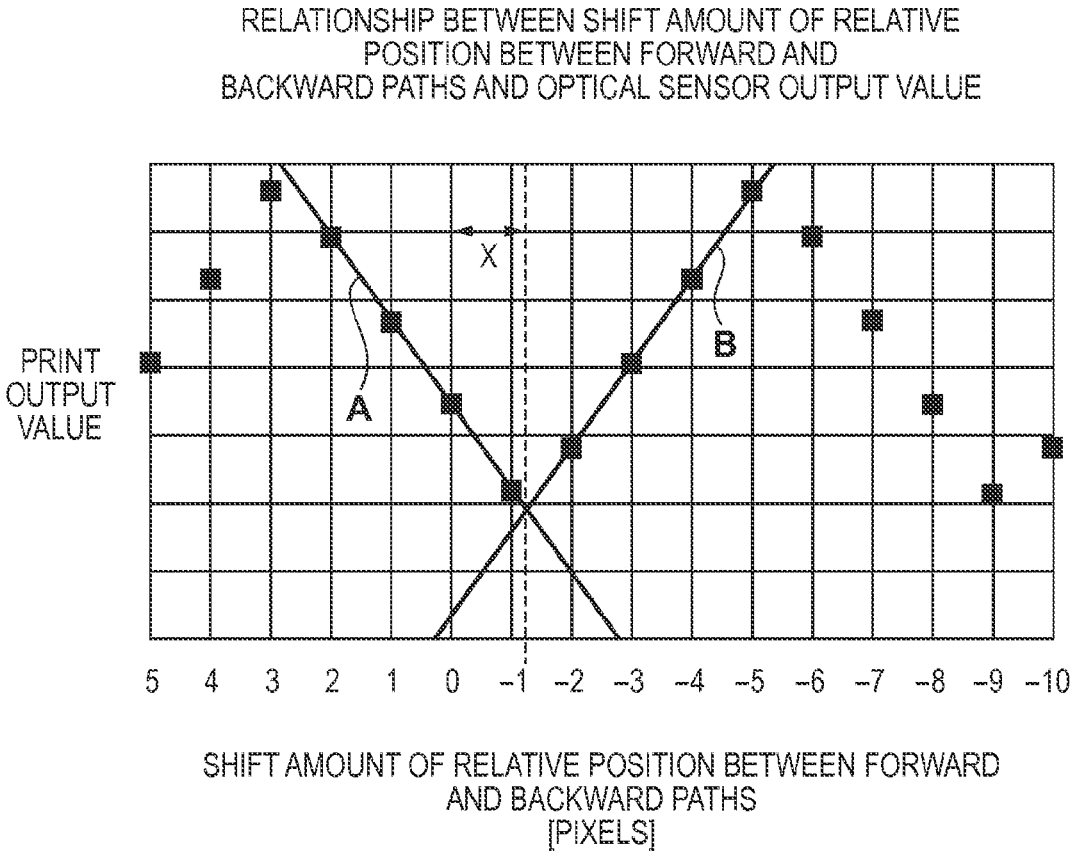
FIG. 21 is a graph showing the relationship between a shift amount between forward and backward paths and output values of an optical sensor, as disclosed in Japanese Patent Laid-Open No. 2000-37936.

Since the output value of the optical sensor indicates an intensity of reflected light, the relationship between a shift amount between forward and backward paths and the output value is as shown in FIG. 21. Note that in FIG. 21, the ordinate plots the reflected light intensity, and the abscissa plots a shift amount (in unit of one dot) of a print position.

Hence, in the relationship shown in FIG. 21, a line A is calculated using the output values of the sample patches SP4, SP5, and SP6, and a line B is calculated using the output values of the sample patches SP8, SP1, and SP2. Next, by calculating an intersection between the lines A and B, a relative shift amount a occurred between the forward and backward paths can be calculated. That is, the relationship between the shift amount of print positions between the forward and backward paths and the output value of the optical sensor can be obtained.

The density method is advantageous in that a correction value is calculated with high precision, but it also is disadvantageous in that an adjustable range is restrictive and the amount of ink and the number of print sheets to be consumed for that adjustment are large.

The patterns used in the registration adjustment based on the density method may use the same patterns used in the registration adjustment according to the range detection method, but patterns unique to the density method may be used. In this case, for example, a pattern which includes a plurality of patches (for example, four dots) each having the same length to be spaced by the same interval (four dots) as the patch length may be used. Therefore, a reference pattern is printed using this pattern at a 50% duty in the main scanning direction. Next, after the reference pattern, an adjustment target pattern is printed at the same position as the reference pattern, using nozzles as measurement targets. In this case, when a registration is shifted by, for example, four dots in the main scanning direction, the reference pattern and adjustment pattern are printed together at a 100% duty in the main scanning direction. This duty difference is observed as a print density difference. Therefore, by measuring the print duty of these patterns using the reflective-type sensor, a registration shift is calculated, and an adjustment value is consequently obtained.

From such situation, a printing apparatus, in which the number of inks to be used is large (for example, 12 colors) and print sheets of large sizes are used, adopts two-step adjustment which utilizes advantages of the range detection method and density method.

Therefore, according to the aforementioned embodiment, since two-step adjustment is executed, both the wide adjustment range and high adjustment precision can be attained as the whole adjustment operations. Also, the influences of external disturbances occurred depending on positions of the carriage in the main scanning direction are eliminated for respective types of correction values, and more suitable correction values can be acquired. Also, suitable correction values from which the influence of printhead slanting is eliminated can also be acquired.

In the aforementioned embodiment, a so-called large-sized printing apparatus which prints on print media of A0 and B0 sizes is used. However, the present invention is applicable to a printing apparatus which prints on print media of relatively small sizes such as A4, A3, B4, and B5.

Furthermore, the aforementioned registration adjustment method is applicable not only to inter-chip correction and inter-head unit correction, but also to inter-substrate correction when a plurality of substrates are mounted on a single head unit. In addition, the aforementioned embodiment has exemplified the heat unit in which a plurality of chips having the same print width are arrayed in the carriage main scanning direction (first direction), as shown in FIGS. 4A and 4B. However, the present invention is not limited to this. For example, the registration adjustment method of the present invention is applicable to an arrangement in which a plurality of chips are arrayed while being shifted in the sub-scanning direction (second direction) in a single head unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-103834, filed Apr. 27, 2012, and 2013-077263, filed Apr. 2, 2013, which are hereby incorporated by reference herein in their entirety.

What is claimed is:

1. A printing apparatus, which executes printing by reciprocally scanning a carriage, to which a printhead having a first nozzle array in which a plurality of nozzles are arrayed in a first direction and a second nozzle array in which a plurality of nozzles are arrayed in the first direction is mounted, in a second direction intersecting with the first direction, comprising:

a first print unit configured to print a first adjustment pattern on a print medium using the first nozzle array and the second nozzle array of the printhead;

a first obtaining unit configured to (i) obtain print positions of two patches of a plurality of patches that form the first adjustment pattern by optically reading the first adjustment pattern and (ii) calculate a distance between the print positions;

a first acquisition unit configured to acquire a first registration adjustment value based on the calculated distance;

a second print unit configured to print, on a print medium, a second adjustment pattern different from the first adjustment pattern using the first nozzle array and the second nozzle array of the printhead in a state in which a registration of the printhead is adjusted by the first registration adjustment value;

a second obtaining unit configured to obtain densities of a plurality of patches that form the second adjustment pattern by optically reading the second adjustment pattern; and a second acquisition unit configured to acquire a second registration adjustment value based on the obtained densities.

2. The apparatus according to claim 1, wherein said first print unit prints the first adjustment pattern to be used for a first adjustment of the registration of the printhead, and said second print unit prints the second adjustment pattern for a second adjustment of the registration of the printhead, the second adjustment being finer than the first adjustment.

3. The apparatus according to claim 1, wherein on the carriage, a plurality of printheads having the same arrangement are mounted to be juxtaposed in the first direction.

4. The apparatus according to claim 1, wherein the printhead includes a plurality of substrates on each of which a plurality of nozzle arrays are arranged, and wherein each of the plurality of nozzle arrays includes a plurality of nozzles.

5. The apparatus according to claim 1, wherein the printhead mounts a plurality of chips in a same direction, and wherein on each of the plurality of chips a plurality of nozzle arrays are arranged in the same direction, each of the plurality of nozzle arrays including a plurality of nozzles.

6. The apparatus according to claim 5, wherein the plurality of nozzle arrays mounted on a chip of the plurality of chips are arranged to be shifted by a length shorter than a pitch interval of the plurality of nozzles in an arrayed direction of nozzles.

7. The apparatus according to claim 1, wherein each of the first adjustment pattern and the second adjustment pattern is formed by printing, on the print medium, a plurality of patches of a same type in a scanning direction of the carriage, and a plurality of patches of different types in a conveyance direction of the print medium.

8. The apparatus according to claim 7, wherein the different types of patches are distinguished from each other depending on if patches are printed by forward print of the printhead, if patches are printed by backward print of the printhead, if patches are printed using different nozzle arrays that print in a same direction, if patches are printed using nozzles of different nozzle numbers in a same nozzle array that print in the same direction, or if patches are printed using a combination thereof.

9. The apparatus according to claim 1, further comprising:

an optical sensor for reading the first adjustment pattern and the second adjustment pattern.

10. The apparatus according to claim 1, wherein one of the two patches of a plurality of patches that form the first adjustment pattern is printed by the first nozzle array of the printhead, and the other of the two patches of a plurality of patches that form the first adjustment pattern is printed by the second nozzle array of the printhead.

11. The apparatus according to claim 1, wherein the plurality of patches that form the second adjustment pattern include a first group of patches printed by the first nozzle array of the printhead and a second group of patches printed by the second nozzle array of the printhead, wherein a part of the first group of patches and a part of the second group of patches overlap with each other, and wherein a degree of overlap is not constant.

12. A registration adjustment method for a printing apparatus, which executes printing by reciprocally scanning a carriage, to which a printhead having a first nozzle array in which a plurality of nozzles are arrayed in a first direction and a second nozzle array in which a plurality of nozzles are arrayed in the first direction is mounted, in a second direction intersecting with the first direction, comprising:

printing a first adjustment pattern on a print medium using the first nozzle array and the second nozzle array of the printhead;

obtaining print positions of two patches of a plurality of patches that form the first adjustment pattern by optically reading the first adjustment pattern;

calculating a distance between the print positions;

acquiring a first registration adjustment value based on the calculated distance;

printing, on a print medium, a second adjustment pattern different from the first adjustment pattern using the first nozzle array and the second nozzle array of the printhead in a state in which a registration of the printhead is adjusted by the first registration adjustment value;

obtaining densities of a plurality of patches that form the second adjustment pattern by optically reading the second adjustment pattern; and acquiring a second registration adjustment value based on the obtained densities.

13. The method according to claim 12, wherein the first adjustment pattern is printed to be used for a first adjustment of the registration of the printhead, and the second adjustment pattern is printed for a second adjustment of the registration of the printhead, the second adjustment being finer than the first adjustment.

14. The method according to claim 12, wherein on the carriage, a plurality of printheads having the same arrangement are mounted to be juxtaposed in the first direction.

15. The method according to claim 12, wherein the printhead includes a plurality of substrates on each of which a plurality of nozzle arrays are arranged, and wherein each of the plurality of nozzle arrays includes a plurality of nozzles.

16. The method according to claim 12, wherein the printhead mounts a plurality of chips in a same direction, and wherein on each of the plurality of chips a plurality of nozzle arrays are arranged in the same direction, each of the plurality of nozzle arrays including a plurality of nozzles.

17. The method according to claim 16, wherein the plurality of nozzle arrays mounted on a chip of the plurality of chips are arranged to be shifted by a length shorter than a pitch interval of the plurality of nozzles in an arrayed direction of nozzles.

18. The method according to claim 12, wherein each of the first adjustment pattern and the second adjustment pattern is formed by printing, on the print medium, a plurality of patches of a same type in a scanning direction of the carriage, and a plurality of patches of different types in a conveyance direction of the print medium.

19. The method according to claim 18, wherein the different types of patches are distinguished from each other depending on if patches are printed by forward print of the printhead, if patches are printed by backward print of the printhead, if patches are printed using different nozzle arrays that print in a same direction, if patches are printed using nozzles of different nozzle numbers in a same nozzle array that print in the same direction, or if patches are printed using a combination thereof.

20. The method according to claim 12, wherein the first adjustment pattern and the second adjustment pattern are optically read by an optical sensor.

21. The method according to claim 12, wherein one of the two patches of a plurality of patches that form the first adjustment pattern is printed by the first nozzle array of the printhead, and the other of the two patches of a plurality of patches that form the first adjustment pattern is printed by the second nozzle array of the printhead.

22. The method according to claim 12, wherein the plurality of patches that form the second adjustment pattern include a first group of patches printed by the first nozzle array of the printhead and a second group of patches printed by the second nozzle array of the printhead, wherein a part of the first group of patches and a part of the second group of patches overlap with each other, and wherein a degree of overlap is not constant.

23. A printing apparatus, which executes printing by reciprocally scanning a carriage, to which a printhead having a first nozzle array in which a plurality of nozzles are arrayed in a first direction and a second nozzle array in which a plurality of nozzles are arrayed in the first direction is mounted, in a second direction intersecting with the first direction, comprising:

a first print unit configured to print a first adjustment pattern, on a print medium, using the first nozzle array and the second nozzle array of the printhead;

a first acquisition unit configured to acquire a first registration adjustment value based on a distance between print positions of two patches of a plurality of patches that form the first adjustment pattern;

a second print unit configured to print, on a print medium, a second adjustment pattern different from the first adjustment pattern using the first nozzle array and the second nozzle array of the printhead in a state in which a registration of the printhead is adjusted by the first registration adjustment value; and a second acquisition unit configured to acquire a second registration adjustment value based on densities of a plurality of patches that form the second adjustment pattern, wherein each of the first adjustment pattern and the second adjustment pattern is formed by printing, on the print medium, a plurality of patches of a same type in a scanning direction of the carriage, and a plurality of patches of different types in a conveyance direction of the print medium, and wherein the types of patches are distinguished from each other depending on if patches are printed by forward print of the printhead, if patches are printed by backward print of the printhead, if patches are printed using different nozzle arrays that print in a same direction, if patches are printed using nozzles of different nozzle numbers in a same nozzle array that print in the same direction, or if patches are printed using a combination thereof.

24. A registration adjustment method for a printing apparatus, which executes printing by reciprocally scanning a carriage, to which a printhead having a first nozzle array in which a plurality of nozzles are arrayed in a first direction and a second nozzle array in which a plurality of nozzles are arrayed in the first direction is mounted, in a second direction intersecting with the first direction, comprising:

printing a first adjustment pattern, on a print medium, using the first nozzle array and the second nozzle array of the printhead;

acquiring a first registration adjustment value based on a distance between print positions of two patches of a plurality of patches that form the first adjustment pattern;

printing, on a print medium, a second adjustment pattern different from the first adjustment pattern using the first nozzle array and the second nozzle array of the printhead in a state in which a registration of the printhead is adjusted by the first registration adjustment value; and acquiring a second registration adjustment value based on densities of a plurality of patches that form the second adjustment pattern, wherein each of the first adjustment pattern and the second adjustment pattern is formed by printing, on the print medium, a plurality of patches of a same type in a scanning direction of the carriage, and a plurality of patches of different types in a conveyance direction of the print medium, and wherein the types are distinguished from each other depending on if patches are printed by forward print of the printhead, if patches are printed by backward print of the printhead, if patches are printed using different nozzle arrays that print in a same direction, if patches are printed using nozzles of different nozzle numbers in a same nozzle array that print in the same direction, or if patches are printed using a combination thereof.

* * * * *